United States Patent [19]

Meyer

[11] 4,017,483

[45] Apr. 12, 1977

[54] COUMARINO-3,4-OXAZOLES

[75] Inventor: Hans Rudolf Meyer, Binningen, Switzerland

[73] Assignee: Ciba-Geigy Corporation, Ardsley, N.Y.

[22] Filed: Oct. 1, 1974

[21] Appl. No.: 510,979

[30] Foreign Application Priority Data

Nov. 1, 1973 Switzerland ..... 15405/73

[52] U.S. Cl. ..... 260/240 D; 260/240 CA; 260/240 E; 260/307 A; 260/307 F

[51] Int. Cl.[2] ..... C07D 263/00

[58] Field of Search .... 260/240 D, 240 CA, 240 E, 260/307 A, 307 F

[56] References Cited

UNITED STATES PATENTS

| | | | |
|---|---|---|---|
| 3,717,652 | 2/1973 | Buell | 260/240 D |
| 3,719,669 | 3/1973 | Shetty | 260/240 D |
| 3,743,639 | 7/1973 | Schlapfer | 260/240 D |
| 3,873,531 | 3/1975 | Elam | 260/240 D |
| 3,926,969 | 12/1975 | Fleck et al. | 260/240 D |

OTHER PUBLICATIONS

Chemical Abstracts, 70, 77840(b) (1969).

*Primary Examiner*—M. J. Welsh
*Attorney, Agent, or Firm*—Joseph G. Kolodny; Edward McC. Roberts; Prabodh I. Almaula

[57] ABSTRACT

The present invention provides new coumarino-3,4-oxazoles. The novel compounds are suitable optical brighteners for high molecular organic materials, especially for polyesters, polyvinyl chloride and polyacryl nitrile.

17 Claims, No Drawings

COUMARINO-3,4-OXAZOLES

The present application relates to new coumarino 3,4-oxazoles, processes for their manufacture and their use for the optical brightening of high molecular organic materials.

The new compounds correspond to the formula

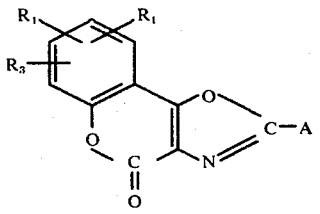

(1)

wherein $R_1$, $R_2$ and $R_3$ independently of one another represent hydrogen or a non-chromophoric substituent or $R_1$ and $R_2$ in the o-position relative to one another together represent an optionally non-chromophorically substituted fused-on benzene radical and A represents an optionally non-chromophorically substituted radical of the formalae

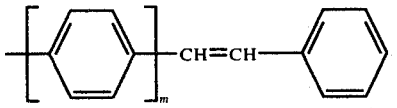

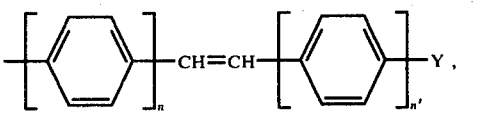

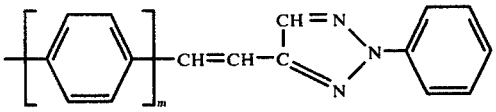

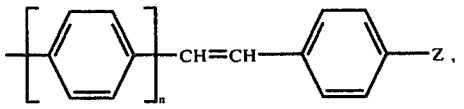

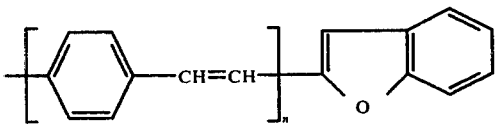

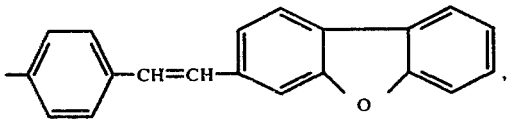

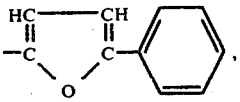

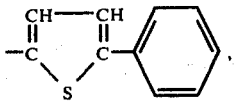

-continued

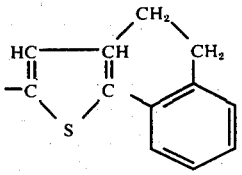

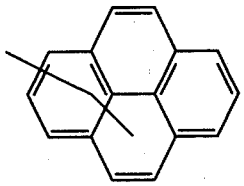

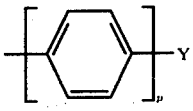

or

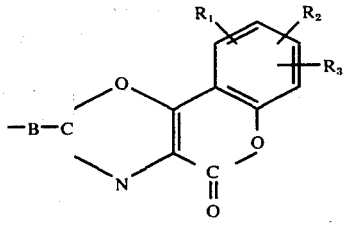

wherein Y represents an optionally non-chromophorically substituted benzoxazol-2-yl, naphthoxazol-2-yl or phenanthreno-9′,10′:4,5-oxazol-2-yl (= phenanthroxyazolyl-2), benzotriazol-2-yl, naphthotriazol-2-yl or phenanthrotriazolyl-2 radical, Z represents a radical having the meaning of Y or an optionally non-chromophorically substituted phenyl, 2-triazolyl, 5-phenyloxdiazol-2-yl, pyrazol-1-yl or 4,6-diphenyl-1,3,5-triazin-2-yl radical, B represents a radical of the formula

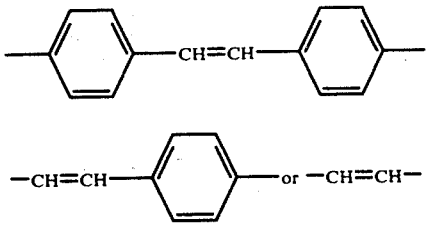

or a 1,4-phenylene, 4,4′-diphenylene, 1,4-naphthylene, 2,6-naphthylene, 2,5-furylene or 2,5-thienylene radical, or a dibenzofurane, dibenzothiophene-dioxide or 9,10-dihydrophenanthrylene-2,7 radical bonded in the 3,7-position to the oxazole radical, *m* represents the numbers 0, 1 or 2, *n* and *n′* represent the number 0 or 1 and *p* represents the number 1 or 2 and the sum of $n + n'$ must be 1 or 2.

Possible non-chromophoric substituents $R_1$, $R_2$ and/or $R_3$ are, above all, optionally hydroxy-substituted alkyl or alkoxy with 1 to 8 carbon atoms, cyclohexyl, phenyl and halogen, such as bromine or chlorine. Examples which may be mentioned of non-chromophoric substituents on the radicals listed for the symbol A are alkyl with 1 to 8 carbon atoms which is optionally substituted by chlorine, hydroxyl or alkoxy with 1 to 4 carbon atoms, halogen, such as bromine and especially chlorine, alkoxy with 1 to 4 carbon atoms, alkylsulphonyl with 1 to 5 carbon atoms which is optionally substituted by chlorine or hydroxyl, aralkyl(1-4C)sulphonyl, such as benzylsulphonyl, phenylsulphonyl which is optionally substituted by chlorine or alkyl with 1 to 4 carbon atoms, alkenyl with 2 to 4 carbon atoms, phenylalkyl with 1 to 3 carbon atoms in the alkyl part which is optionally substituted in the phenyl by chlorine or methyl, phenoxy which is optionally substituted by chlorine or methyl, optionally functionally modified carboxyl, nitrile, optionally functionally modified sulpho, optionally functionally modified amino, alkan(1-4C)oyloxy or phenyl which is optionally substituted by chlorine or alkyl with 1 to 4 carbon atoms. Non-chromophoric substituents are also to be understood to include divalent radicals, such as dioxymethylene, or fused-on radicals, such as, for example, fused-on benzene radicals.

By functionally modified carboxyl and sulpho groups there are to be understood the salts, esters or amides of these groups. As examples there may be mentioned carbalkoxy with 2 to 5 carbon atoms, carbamoyl monosubstituted or disubstituted at the nitrogen by alkyl or hydroxyalkyl with 1 to 4 carbon atoms, morpholinocarbonyl or piperidinocarbonyl, phenoxysulphonyl, alkoxy(1-4C)sulphonyl, sulphamoyl monosubstituted or disubstituted at the nitrogen by alkyl or hydroxyalkyl with 1 to 4 carbon atoms, morpholinosulphonyl or piperidinosulphonyl. Mono- or di-alkyl(1-4C)amino, mono- or di-(hydroxy)alkyl(1-4C)amino or alkan(1-4C)oyl-amino may be mentioned as functionally modified amino.

Within the scope of the formula (1), compounds of particular interest are those of the following formaulae:

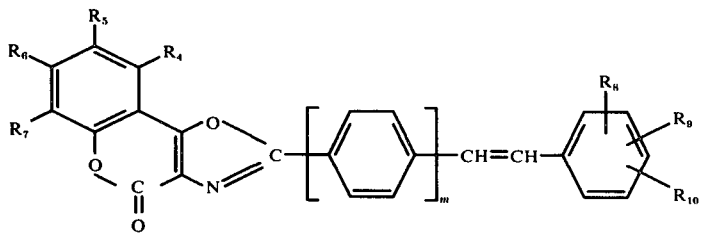

(2)

wherein two of the radicals $R_4$, $R_5$, $R_6$ and $R_7$ denote hydrogen and the others independently of one another denote hydrogen, alkyl with 1 to 4 carbon atoms, alkoxy with 1 to 4 carbon atoms or chlorine, or $R_4$ and $R_5$, $R_5$ and $R_6$ or $R_6$ and $R_7$ together denote a fused-on benzene ring, $R_8$ denotes hydrogen, halogen, alkyl with 1 to 4 carbon atoms, phenyl, alkylsulphonyl with 1 to 4 carbon atoms, benzylsulphonyl, phenylsulphonyl which is optionally substituted by alkyl with 1 to 4 carbon atoms, nitrile or a radical

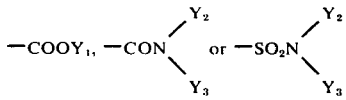

wherein $Y_1$ represents hydrogen, alkyl with 1 to 4 carbon atoms, alkoxy(1-4C)-alkyl(1-4C), cyclohexyl, benzyl or phenyl and $Y_2$ and $Y_3$ independently of one another represent hydrogen or optionally hydroxy-substituted alkyl with 1 to 4 carbon atoms or both together with the nitrogen represent a piperidine or morpholine radical, $R_9$ and $R_{10}$ independently of one another denote hydrogen, chlorine, alkyl with 1 to 4 carbon atoms or alkoxy with 1 to 4 carbon atoms and furthermore $R_8$, if $R_9$ and $R_{10}$ represent hydrogen and *m* represents 0 or 1, denotes a radical

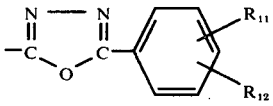

which is in the p-position to the ethylene bridge and wherein $R_{11}$ represents hydrogen, chlorine, alkyl with 1 to 4 carbon atoms, alkoxy with 1 to 4 carbon atoms, phenyl or carbalkoxy with 2 to 5 carbon atoms and $R_{12}$ represents hydrogen or alkyl with 1 to 4 carbon atoms, and *m* denotes a number 0, 1 or 2, preferably 1;

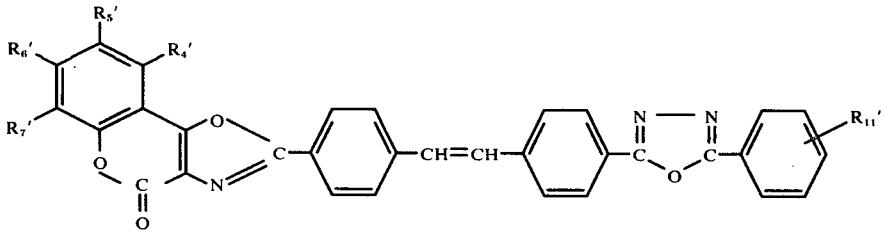

(3)

wherein two of the radicals $R_4'$, $R_5'$, $R_6'$ and $R_7'$ represent hydrogen and the others independently of one another represent hydrogen or alkyl with 1 to 4 carbon atoms or $R_4'$ and $R_5'$ together represent a fused-on benzene ring and $R_{11}'$ represents hydrogen, chlorine, alkyl with 1 to 4 carbon atoms, alkoxy with 1 to 4 carbon atoms, phenyl or carbalkoxy with 2 to 5 carbon atoms;

(4)

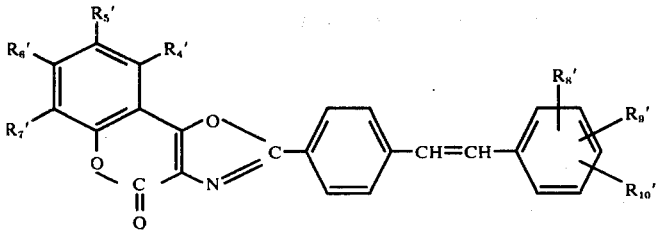

wherein $R_4'$, $R_5'$, $R_6'$ and $R_7'$ have the abovementioned meaning, $R_8'$ represents hydrogen, halogen, alkyl with 1 to 4 carbon atoms, phenyl, alkylsulphonyl with 1 to 4 carbon atoms, benzylsulphonyl, phenylsulphonyl which is optionally substituted by alkyl with 1 to 4 carbon atoms, nitrile, carboxyl, carbalkoxy with 2 to 5 carbon atoms or a radical

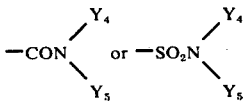

wherein $Y_4$ and $Y_5$ independently of one another represent hydrogen or alkyl with 1 to 4 carbon atoms, and $R_9'$ and $R_{10}'$ independently of one another represent hydrogen, chlorine, alkyl with 1 to 4 carbon atoms or alkoxy with 1 to 4 carbon atoms;

(5)

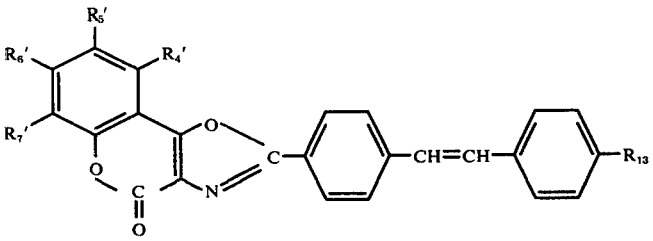

wherein $R_4'$, $R_5'$, $R_6'$ and $R_7'$ have the abovementioned meaning and $R_{13}$ represents hydrogen, nitrile, carbalkoxy with 2 to 5 carbon atoms, phenyl or alkylsulphonyl with 1 to 4 carbon atoms;

(6)

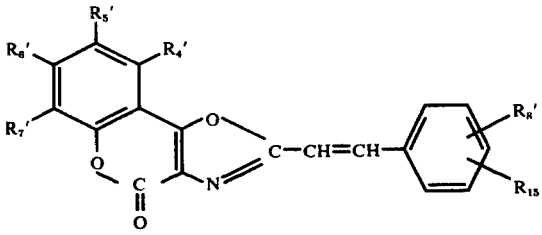

wherein $R_4'$, $R_5'$, $R_6'$, $R_7'$ and $R_8'$ have the abovementioned meaning and $R_{15}$ represents hydrogen, alkyl with 1 to 4 carbon atoms or chlorine;

(7)

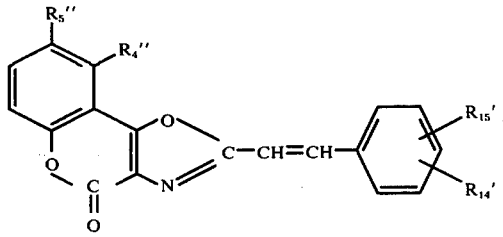

wherein $R_4''$ and $R_5''$ denote hydrogen or together denote a fused-on benzene radical, $R_{14}'$ denotes hydrogen, nitrile, alkoxy with 1 to 4 carbon atoms or carbalkoxy with 2 to 5 carbon atoms or together with $R_{15}'$ denotes a fused-on benzene radical, and $R_{15}'$ denotes hydrogen or together with $R_{14}'$ denotes a fused-on benzene radical;

(8)

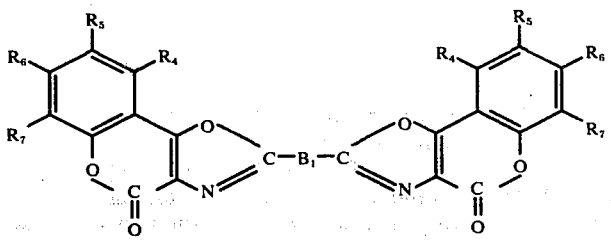

wherein $R_4$, $R_5$, $R_6$ and $R_7$ have the abovementioned meaning and $B_1$ represents a radical

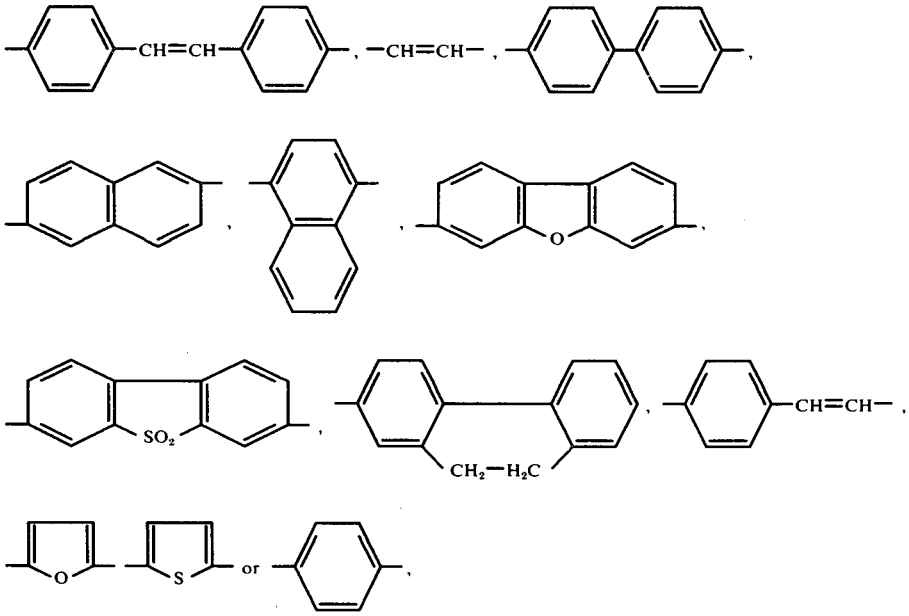

(9)

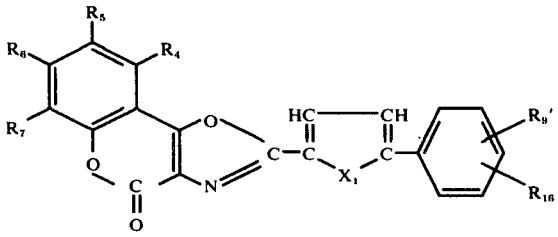

wherein $R_4$, $R_5$, $R_6$ and $R_7$ have the abovementioned meaning, $R_9'$ represents hydrogen, chlorine, alkyl with 1 to 4 carbon atoms or alkoxy with 1 to 4 carbon atoms, $R_{16}$ represents hydrogen, chlorine, alkyl with 1 to 4 carbon atoms, alkoxy with 1 to 4 carbon atoms, nitrile carbalkoxy with 2 to 5 carbon atoms, alkylsulphonyl with 1 to 4 carbon atoms or phenylsulphonyl and $X_1$ represents oxygen or sulphur;

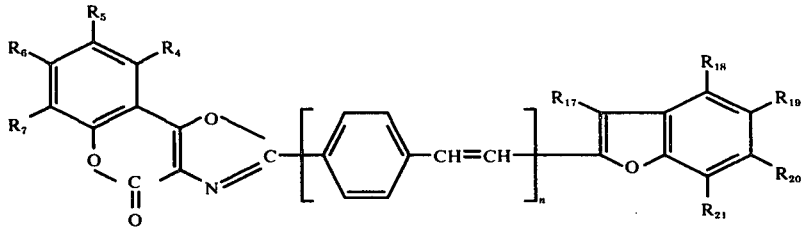

(10)

wherein $R_4$, $R_5$, $R_6$, $R_7$ and $n$ have the abovementioned meaning, $R_{17}$ represents hydrogen, methyl or phenyl, two of the radicals $R_{18}$, $R_{19}$, $R_{20}$ and $R_{21}$ represent hydrogen and the two others independently of one another represent hydrogen, chlorine, alkyl with 1 to 4 carbon atoms or alkoxy with 1 to 4 carbon atoms or $R_{18}$ and $R_{19}$ together represent a fused-on benzene radical;

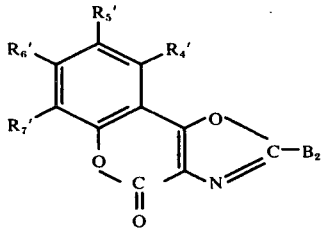

(11)

wherein $R_4'$, $R_5'$, $R_6'$ and $R_7'$ have the abovementioned meaning and $B_2$ represents a radical of the formula

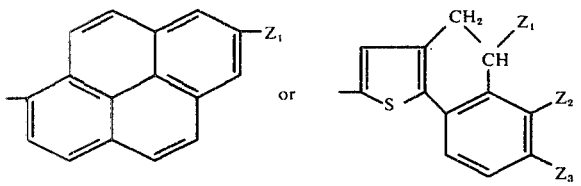

wherein $Z_1$ represents hydrogen or alkyl with 1 to 4 carbon atoms and $Z_2$ and $Z_3$ independently of one another represent hydrogen, chlorine or alkyl with 1 to 4 carbon atoms;

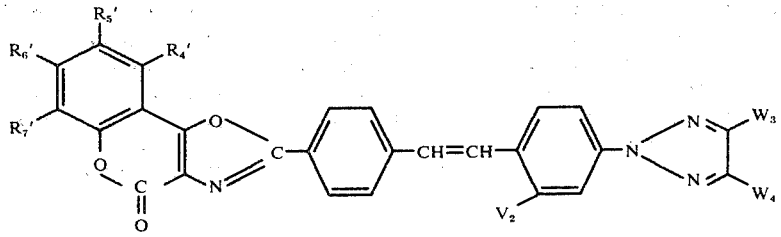

(14)

wherein $R_4'$, $R_5'$, $R_6'$ and $R_7'$ have the abovementioned meaning, $V_2$ represents hydrogen or alkylsulphonyl with 1 to 4 carbon atoms, $W_3$ represents hydrogen, chlorine, alkyl with 1 to 4 carbon atoms, carbalkoxy with 2 to 5 carbon atoms or nitrile, $W_4$ represents hydrogen, alkyl with 1 to 4 carbon atoms, phenyl or styryl or $W_3$ and $W_4$ together represent a fused-on benzene ring which can be substituted in the 5-position by alkyl

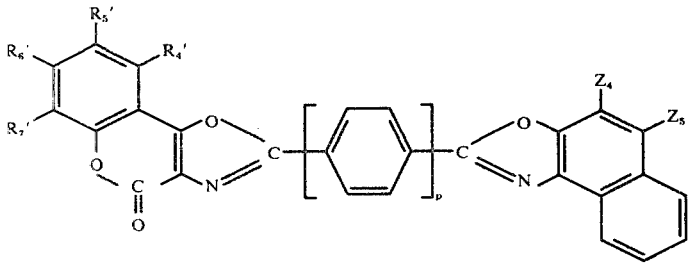

(12)

wherein $R_4'$, $R_5'$, $R_6$, $R_7'$ and $p$ have the abovementioned meaning, $Z_4$ represents hydrogen, nitrile, carboxyl, carbalkoxy with 2 to 5 carbon atoms or carbamoyl or together with $Z_5$ represents a fused-on benzene ring and $Z_5$ represents hydrogen or together with $Z_4$ represents a fused-on benzene ring;

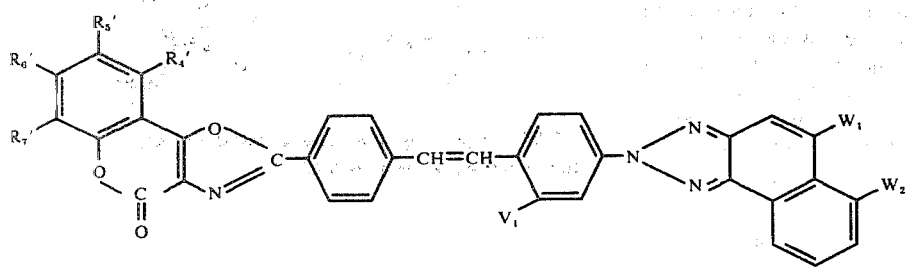

(13)

wherein $R_4'$, $R_5'$, $R_6'$ and $R_7'$ have the abovementioned meaning, $V_1$ represents hydrogen, nitrile or alkylsulphonyl with 1 to 4 carbon atoms and $W_1$ and $W_2$ represent hydrogen or together represent an ethylene bridge;

other represent hydrogen, chlorine or alkyl with 1 to 4 carbon atoms;

wherein $R_4'$, $R_5'$, $R_6'$ and $R_7'$ have the abovementioned meaning, $V_2$ represents hydrogen or alkylsulphonyl with 1 to 4 carbon atoms or alkoxy with 1 to 4 carbon atoms and can be substituted in the 6-position by alkoxy with 1 to 4 carbon atoms, or represent a fused-on naphthalene or acenaphthene radical;

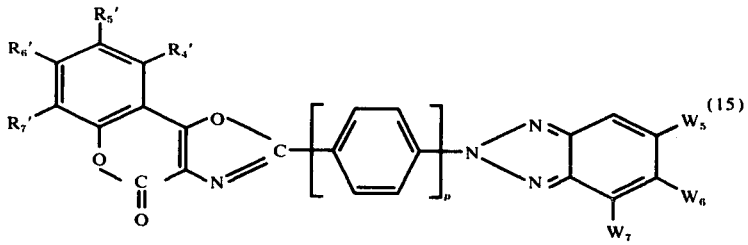

(15)

wherein $R_4'$, $R_5'$, $R_6'$, $R_7'$ and $p$ have the abovementioned meaning, $W_5$ represents alkyl with 1 to 4 carbon atoms or alkoxy with 1 to 4 carbon atoms, $W_6$ represents alkoxy with 1 to 4 carbon atoms and $W_7$ represents hydrogen, or $W_5$ represents hydrogen and $W_6$ and $W_7$ together represent the supplementary portion required to form a naphthalene radical or $W_5$ and $W_7$ together represent the supplementary portion required to form an acenaphthene radical;

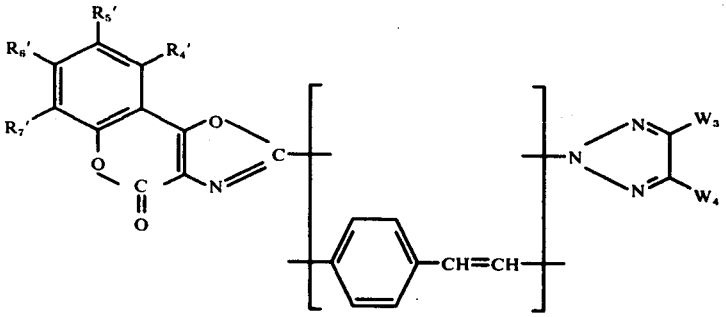

(16)

wherein $R_4'$, $R_5'$, $R_6'$, $R_7'$, $W_3$ and $W_4$ have the abovementioned meaning, and

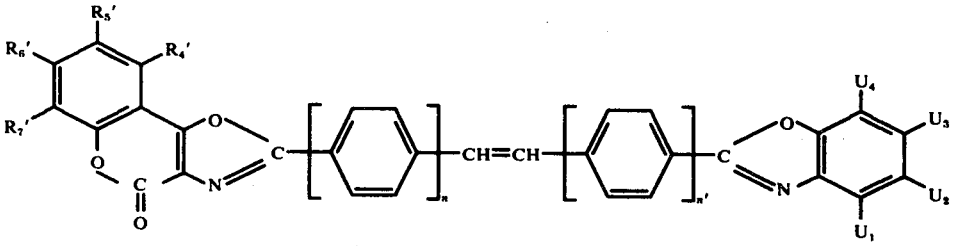

(17)

wherein $R_4'$, $R_5'$, $R_6'$, $R_7'$, $n$ and $n'$ have the abovementioned meaning, $U_1$ represents hydrogen or together with $U_2$ represents a fused-on benzene radical, $U_2$ represents hydrogen, chlorine, alkyl with 1 to 4 carbon atoms, carbalkoxy with 2 to 5 carbon atoms, phenyl, alkylsulphonyl with 1 to 4 carbon atoms or phenylsulphonyl or together with $U_1$ represent a fused-on benzene radical and $U_3$ represents hydrogen, methyl or phenyl and $U_4$ represents hydrogen or alkyl with 1 to 4 carbon atoms.

Within the scope of the formula (2) or of the subordinate formulae (4) to (7), those compounds are preferred which have, on the terminal phenyl radical, at least one substituent possessing an electron-attracting action, that is to say a substituent from the series halogen, alkylsulphonyl, benzylsulphonyl, phenylsulphonyl, nitrile, —COOY,

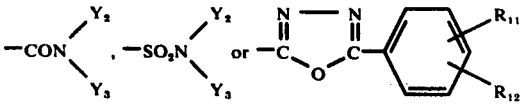

Individual compounds of particular practical interest correspond to the formulae (18)

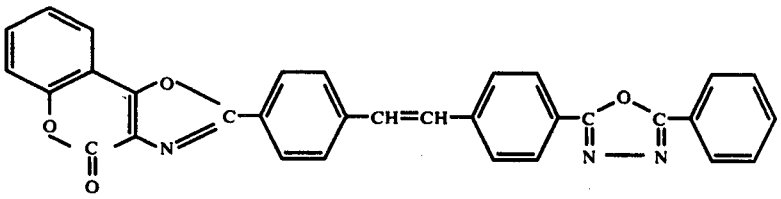

-continued (19)

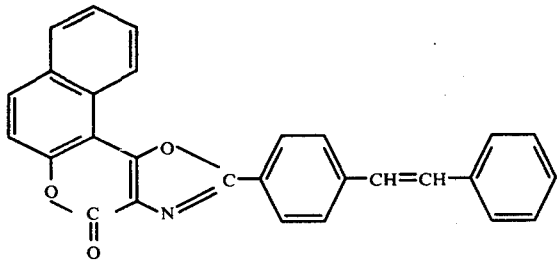

(20)

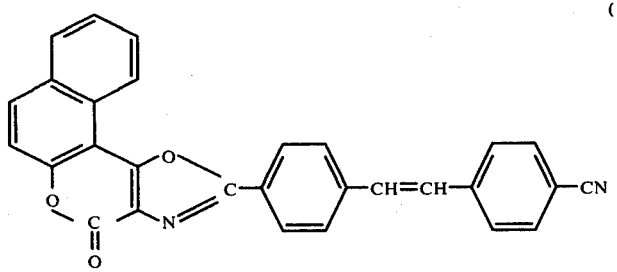

The new compounds of the formula (1) or of subordinate formulae can be manufactured analogously to known processes. For example, 3-amino-4-hydroxy-coumarins of the formula

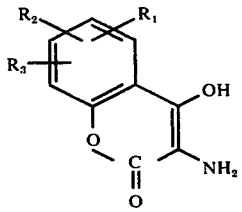

(21)

wherein $R_1$, $R_2$ and $R_3$ have the abovementioned meaning can be condensed with carboxylic acid derivatives of the formula $$Q - A \qquad (22)$$

wherein A has the abovementioned meaning and Q represents a —COCl, —COBr, —COOH, —COOalkyl(1-4C) or —CN radical, at 120 to 350° C, optionally in the presence of a catalyst which effects the elimination of hydrogen chloride, hydrogen bromide, water, alcohol or ammonia, in a solvent which is inert towards the reactants or in the melt; preferably, the acid amide of the formula

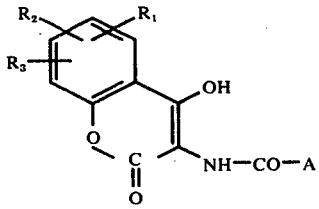

(23)

which is produced in the first stage is isolated and then subjected to the cyclisation reaction under energetic conditions.

Examples of suitable inert solvents are dioxane, dichlorobenzene, trichlorobenzene, nitrobenzene, chlorinated biphenyl or dibutyl phthalate; examples of suitable agents which split off hydrogen halide are bases such as pyridine, picolines, triethylamine, quinoline and N,N-dimethylaniline. Further suitable condensation agents are thionyl chloride, phosphorus oxychloride, phosphorus pentoxide, polyphosphoric acid of various degrees of hydration including pyrophosphoric acid, boric acid, zinc chloride, p-toluenesulphonic acid and the like.

In another process, 3-amino-4-hydroxy-coumarins of the formula (21) are reacted at temperatures of 20° to 200° C with aldehyde derivatives of the formula $$A - CHO \qquad (24)$$

wherein A has the abovementioned meaning to give azomethines of the formula

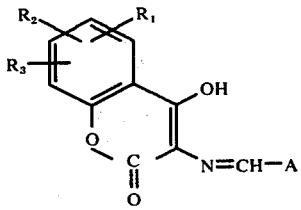

(25)

and these are subsequently oxidised in suitable solvents to the corresponding coumarino-oxazoles, for example using lead tetraacetate in glacial acetic acid or nitrobenzene at elevated temperature, hydrogen peroxide or sodium nitrite in organic acids, chloranil, manganese dioxide, sodium hypochlorite and the like.

The 3-amino-4-hydroxy-coumarin derivatives of the formula (21) used as starting products are obtained by coupling the corresponding 4-hydroxycoumarins with phenyldiazonium chloride and subsequently reducing the resulting 3-phenylazo-4-hydroxy-coumarins [Monatsh. 97 (1966), 77–86] either catalytically with hydrogen in the presence of 5 to 10% of Raney nickel in dioxane or with 2.2 mols of sodium hydrosulphite in boiling 1:1 alcohol/water. The melting points of some such products are listed in Table A.

TABLE A (Melting point in ° C)

| Substituents | 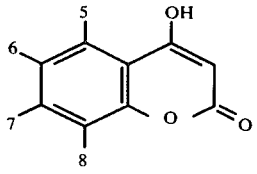 | 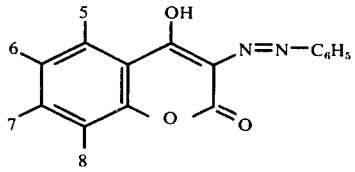 | 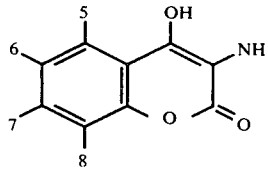 |
|---|---|---|---|
| 5-Methyl-8-isopropyl | 223 | 162 | 214 |
| 6-Methyl | 252 | 192 (decomposition) | 236 (decomposition) |
| 7-Methyl | 222 | 240 | approx. 216 (decomposition) |
| 8-Methyl | 231 | 194 | 243 |
| 6-tert.-Butyl | 212 | 195 | approx. 207 |
| 5,6-Benzo | 280 (decomposition) | 217 | approx. 250 (decomposition) |
| 7,8-Benzo | 284 | 194 | 258 (decomposition) |
| 6-Methoxy | 270 (decomposition) | 184 | 234 (decomposition) |
| 6-$OCH_2CH_2OH$ | 193 | 150 | 215 (decomposition) |

Further 4-hydroxycoumarins which can be employed for the manufacture of corresponding 3-amino-4-hydroxy-coumarin derivatives are listed in Table B.

TABLE B

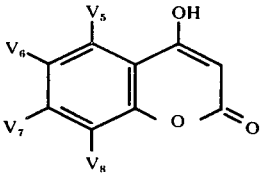

| $V_5$ | $V_6$ | $V_7$ | $V_8$ | Melting Point ° C |
|---|---|---|---|---|
| H | 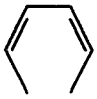 | | H | 235 |
| $-OCH_3$ | H | $-OCH_3$ | H | 183 |
| H | H | $-OCH_3$ | H | 256 |
| H | $-CH_3$ | $-CH_3$ | H | 243 |
| H | Cl | H | $-CH_3$ | 280 |
| H | Cl | H | H | 264 |
| H | Cl | Cl | H | 268 |
| H | Br | H | H | 276 |
| H | 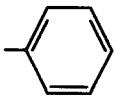 | H | H | 257 |
| H | $-CH_3$ | H | $-CH_3$ | 246 |
| $-CH_3$ | H | H | $-CH_3$ | 254 |
| H | $-CH_3$ | H | $-CH_3$ | 246 |
| $-CH_3$ | $-CH_3$ | H | $-CH_3$ | 268 |
| $-CH_3$ | H | isopropyl | H | 234 |

The compounds of the formulae (22) and (24) to be used as starting products are known or are manufactured analogously to processes which are in themselves known.

The new compounds defined above show, in the dissolved or finely divided state, a more or less pronounced fluorescence. They can be used for the optical brightening of the most diverse synthetic, semi-synthetic or natural organic materials or substances which contain such organic materials.

The following groups of organic materials, where optical brightening thereof is relevant, may be mentioned as examples of the above, without the survey which follows being intended to express any limitation thereto: I. Synthetic organic high molecular materials:

a. Polymerisation products based on organic compounds containing at least one polymerisable carbon-carbon double bond, that is to say their homopolymers or copolymers as well as their after-treatment products such as, for example, cross-linking, grafting or degradation products, polymer blends or products obtained by modification of reactive groups, for example polymers based on $\alpha,\beta$-unsaturated carboxylic acids or derivatives of such carboxylic acids, especially on acrylic compounds (such as, for example, acrylic esters, acrylic acid, acrylontrile, acrylamides and their derivatives or their methacryl analogues), on olefine hydrocarbons (such as, for example, ethylene, propylene, styrenes or dienes and also so-called ABS polymers), and polymers based on vinyl and vinylidene compounds (such as, for example, vinyl chloride, vinyl alcohol and vinylidene chloride), b. polymerisation products which are obtainable by ring opening, for example polyamides of the polycaprolactam type, and also polymers which are obtainable both via polyaddition and via polycondensation, such as polyethers or polyacetals, c. polycondensation products or precondensates based on bifunctional or polyfunctional compounds possessing condensable groups, their homocondensation and co-condensation products, and after-treatment products, such as, for example, polyesters, especially saturated (for example ethylene glycol terephthalic acid polyester) or unsaturated (for example maleic acid-dialcohol polycondensates as well as their crosslinking products with copolymerisable vinyl monomers), unbranched and branched (also including those based on polyhydric alcohols, such as, for example alkyd resins) polyesters, polyamides (for example hexamethylenediamine adipate), maleate resins, melamine resins, their precondensates and analogues, polycarbonates and silicones, and d. polyaddition products such as polyurethanes (crosslinked and non-crosslinked) and epoxide resins. II. Semi-synthetic organic materials, for example cellulose esters of varying degrees of esterification (so-called 2½-acetate or triacetate) or cellulose ethers, regenerated cellulose (viscose or cuprammonium cellulose), or their after-treatment products, and casein plastics. III. Natural organic materials of animal or vegetable origin, for example based on cellulose or proteins, such as cotton, wool, linen, silk, natural lacquer resins, starch and casein.

The brightening of cellulose acetates, polyurethane and polystyrene is of particular practical interest.

The organic materials to be optically brightened can be in the most diverse states of processing (raw materials, semi-finished goods or finished goods). On the other hand, they can be in the form of structures of the most diverse shapes, that is to say, for example, predominantly three-dimensional bodies such as sheets, profiles, injection mouldings, various machined articles, chips, granules or foams, and also as predominantly two-dimensional bodies such as films, foils, lacquers, coatings, impregnations and coatings, or as predominantly one-dimensional bodies such as filaments, fibres, flocks and wires. The said materials can, on the other hand, also be in an unshaped state, in the most diverse homogeneous or inhomogeneous forms of division, such as, for example, in the form of powders, solutions, emulsions, dispersions, latices, pastes or waxes.

Fibre materials can, for example, be in the form of endless filaments (stretched or unstretched), staple fibres, flocks, hanks, textile filaments, yarns, threads, fibre fleeces, felts, waddings, flocked structures or woven textile fabrics, textile laminates, knitted fabrics and papers, cardboards or paper compositions.

The compounds to be used according to the invention are of importance, inter alia, for the treatment of organic textile materials, especially woven textile fabrics. Where fibres, which can be in the form of staple fibres or endless filaments or in the form of hanks, woven fabrics, knitted fabrics, fleeces, flocked substrates or laminates, are to be optically brightened according to the invention, this is advantageously effected in an aqueous medium, wherein the compounds in question are present in a finely divided form (suspensions, so-called microdispersions or possibly solutions). If desired, dispersing agents, stabilisers, wetting agents and further auxiliaries can be added during the treatment.

Depending on the type of brightener compound used, it may prove advantageous to carry out the treatment in a neutral or alkaline or acid bath. The treatment is usually carried out at temperatures of about 20° to 140° C, for example at the boiling point of the bath or near it (about 90° C). Solutions or emulsions in organic solvents can also be used for the finishing, according to the invention, of textile substrates, as is practised in the dyeing trade in so-called solvent dyeing (pad-thermofix application, or exhaustion dyeing process in dyeing machines).

The new optical brighteners according to the present invention can further be added to, or incorporated into, the materials before or during their shaping. Thus they can, for example, be added to the compression moulding composition or injection moulding composition during the manufacture of films, sheets (for example hot milling into polyvinyl chloride) or mouldings.

Where fully synthetic or semi-synthetic organic materials are being shaped by spinning processes or via spinning compositions, the optical brighteners can be applied in accordance with the following processes:

Addition to the starting substances (for example monomers) or intermediates (for example precondensates or prepolymers), that is to say before or during the polymerisation, polycondensation or polyaddition, powdering onto polymer chips or granules for spinning compositions, bath dyeing of polymer chips or granules for spinning compositions, metered addition to spinning melts or spinning solutions, and application to the tow before stretching.

The new optical brighteners according to the present invention can, for example, also be employed in the following use forms:

a. mixed with dyestuffs (shading) or pigments (coloured pigments or especially, for example, white pigments), or as an additive to dyebaths, printing pastes, discharge pastes or reserve pastes, or for the after-treatment of dyeings, prints or discharge prints, b. mixed with so-called "carriers," wetting agents, plasticisers, swelling agents, anti-oxidants, light protection agents, heat stabilizers and chemical bleaching agents (chlorite bleach or bleaching bath additives), c. mixed with crosslinking agents or finishing agents (for example starch or synthetic finishes), and in combination with the most diverse textile finishing processes, especially synthetic resin finishes (for example creaseproof finishes such as "wash-and-wear," "permanent-press" or "no-iron"), as well as flameproof finishes, soft handle finishes, anti-soiling finishes or anti-static finishes, or anti-microbial finishes, d. incorporation of the optical brighteners into polymeric carriers (polymerisation, polycondensation or polyaddition products), in a dissolved or dispersed form, for use, for example, in coating agents, impregnating agents or binders (solutions, dispersions and emulsions) for textiles, fleeces, paper and leather, e. as additives to so-called "master batches,"

f. as additives to the most diverse industrial products in order to render these more marketable (for example improving the appearance of soaps, detergents and pigments), g. in combination with other optically brightening substances, h. in spinning bath preparations, that is to say as additives to spinning baths such as are used for improving the slip for the further processing of synthetic fibres, or from a special bath before the stretching of the fibre, and i. as scintillators for various purposes of a photographic nature, such as, for example, for electrophotographic reproduction or supersensitisation, and for the optical brightening of photographic layers, optionally in combination with white pigments such as, for example, $TiO_2$.

If the brightening process is combined with textile treatment methods or finishing methods, the combined treatment can in many cases advantageously be carried out with the aid of appropriate stable preparations, which contain the optically brightening compounds in such concentration that the desired brightening effect is achieved.

In certain cases, the brighteners are made fully effective by an after-treatment. This can, for example, represent a chemical treatment (for example acid treatment), a thermal treatment (for example heat) or a combined chemical/thermal treatment. Thus, for example, the appropriate procedure to follow in optically brightening a series of fibre substrates, for example of polyester fibres, with the brighteners according to the invention is to impregnate these fibres with the aqueous dispersions (or optionally also solutions) of the brighteners at temperatures below 75° C, for example at room temperature, and to subject them to a dry heat treatment at temperatures above 100° C, it being generally advisable additionally to dry the fibre material beforehand at a moderately elevated temperature, for example at not less than 60° C and up to about 130° C. The heat treatment in the dry state is then advantageously carried out at temperatures between 120° and 225° C, for example by heating in a drying chamber, by ironing within the specified temperature range or by treatment with dry, superheated steam. The drying and dry heat treatment can also be carried out in immediate succession or be combined in a single process stage.

The amount of the new optical brighteners to be used according to the invention, relative to the material to be optically brightened, can vary within wide limits. A distinct and durable effect is already achievable with very small amounts, in certain cases, for example, amounts of 0.0005 percent by weight. However, amounts of up to about 0.8 percent by weight and optionally of up to about 2 percent by weight can also be employed. For most practical purposes, amounts between 0.005 and 0.5 percent by weight are of preferred interest.

Some representatives are also suitable for use as additives for wash liquors or industrial and domestic washing agents, to which they can be added in various ways. They are appropriately added to wash liquors in the form of their solutions in water or organic solvents or in a finely divided form, as aqueous dispersions. They are advantageously added to domestic or industrial washing agents in any stage of the manufacturing process of the washing agents, for example to the so-called "slurry" before spray-drying to the washing powder, or during the preparation of liquid washing agent combinations. They can be added either in the form of a solution or dispersion in water or other solvents or, without auxiliaries, as a dry brightening powder. For example, the brightening agents can be mixed, kneaded or ground with the detergent substances and, in this form, admixed to the finished washing powder. However, they can also be sprayed in a dissolved or pre-dispersed form onto the finishing washing agent.

Possible washing agents are the known mixtures of detergent substances such as, for example, soap in the form of chips and powders, synthetics, soluble salts of sulphonic acid half-esters of higher fatty alcohols, arylsulphonic acids with higher and/or multiple alkyl substituents, sulphocarboxylic acid esters of medium to higher alcohols, fatty acid acylaminoalyl- or acylaminoaryl-glycerinesulphonates, phosphoric acid esters of fatty alcohols and the like. Possible so-called "builders" which can be used are, for example, alkali metal polyphosphates and polymetaphosphates, alkali metal pyrophosphates, alkali metal salts of carboxymethylcellulose and other "soil redeposition inhibitors," and also alkali metal silicates, alkali metal carbonates, alkali metal borates, alkali metal perborates, nitrilotriacetic acid, ethylenediaminotetraacetic acid, and foam stabilisers such as alkanolamides of higher fatty acids. The washing agents can further contain for example: antistatic agents, skin protection agents which restore fat, such as lanolin, enzymes, antimicrobial agents, perfumes and dyestuffs.

The new optical brighteners have the particular advantage that they are also active in the presence of active chlorine donors such as, for example, hypochlorite, and can be used without significant loss of effect in wash liquors containing non-ionic washing agents, for example alkylphenol polyglycol ethers.

The compounds according to the invention are added in amounts of 0.005 to 1% or more, relative to the weight of the liquid or pulverulent finished washing agent. Wash liquors which contain the indicated amounts of the optical brighteners claimed impart a brilliant appearance in daylight when used to wash textiles of cellulose fibres, polyamide fibres, cellulose fibres with a high quality finish, polyester fibres, wool and the like.

The washing treatment is carried out as follows, for example:

The textiles indicated are treated for 1 to 30 minutes at 20 to 100° C in a wash liquor which contains 1 to 10 g/kg of a built-up composite washing agent and 0.05 to 1%, relative to the weight of the washing agent, of the claimed brightening agents. The liquor ratio can be 1:3 to 1:50. After washing, the textiles are rinsed and dried in the usual manner. The wash liquor can contain 0.2 g/l of active chlorine (for example as hypochlorite) or 0.1 to 2 g/l of sodium perborate as a bleaching additive.

In the examples the parts, unless otherwise stated, are always parts by weight and the percentages are always percentages by weight. Unless otherwise noted, melting points and boiling points are uncorrected and determined in an evacuated tube.

EXAMPLE 1

8.9 of stilbene-4-carboxylic acid 4'-carboxylic acid ethyl ester in 100 ml of perchloroethylene and 10 ml of thionyl chloride are boiled under reflux until the evolution of hydrogen chloride has ceased. The solution is evaporated completely in vacuo. 5.5 g of 3-amino-4-hydroxycoumarin and 60 ml of pyridine are added to the acid chloride obtained and the suspension is heated for about one hour under reflux. After cooling, the acid amide which has precipitated, of the formula (101)

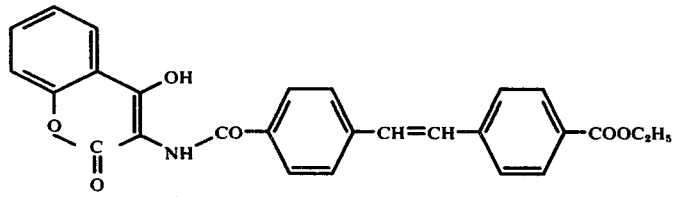

is filtered off, repeatedly washed with methanol and dried. (In the case of other pyridine-soluble acid amides, the latter can be precipitated by adding a little water or be separated out by sucking off the pyridine in vacuo and boiling up the residue in methanol). 12.1 g are obtained as a yellow powder of melting point 234° C (incomplete melting).

The product, in 5.1 ml of phosphorus oxychloride, 0.1 ml of pyridine and 40 ml of o-dichlorobenzene, is heated to the reflux temperature for one hour, excess phosphorus oxychloride is distilled off under normal pressure and the remaining solvent is distilled off in vacuo. The residue is boiled up in 35 ml of methylcellosolve, the mixture is cooled and the product is filtered off and washed with methylcellosolve.

9.9 g of the compound of the formula (102)

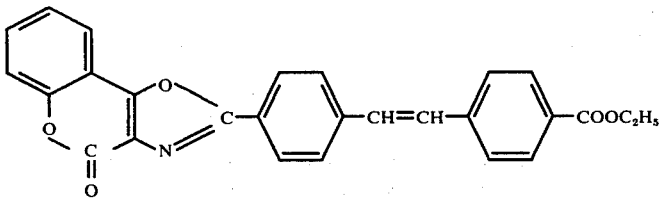

are obtained, having an (ill-defined) melting point at 226° C after recrystallisation from dimethylformamide and chlorobenzene.

EXAMPLE 2

6.1 g of stilbenedicarboxylic acid dichloride are added to a solution of 7.4 g of 3-amino-4-hydroxy-coumarin in 100 ml of pyridine and the mixture is boiled under reflux for one hour. After cooling, the precipitate is filtered off, washed with pyridine and methanol and dried. The resulting acid amide (9.8 g), in 60 ml of dibutyl phthalate, is heated to the boil whilst passing nitrogen into the mixture, after which 10 ml of solvent are distilled off over the course of about 2 hours. After cooling, the product which has precipitated is filtered off, repeatedly washed with ethyl acetate and alcohol and dried. 7.9 g of the compound of the formula (103)

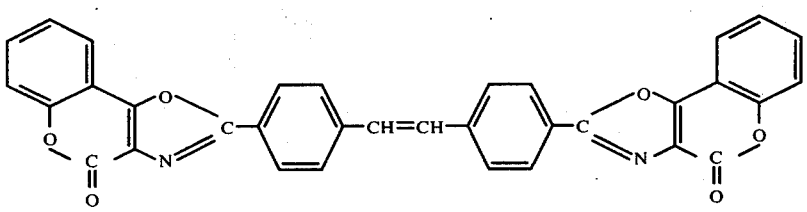

of melting point >400° C are obtained. Light yellow, glistening crystals are obtained after boiling with N-methylpyrrolidone and high vacuum sublimation at 400 to 430° C.

EXAMPLE 3

An intimate mixture of 4.1 g of DL-malic acid and 14.0 g of 3-amino-4-hydroxy-5-methyl-8-isopropyl-coumarin in 60 g of polyphosphoric acid is stirred under nitrogen for 5 hours at 190° C. After cooling to about 80° C, 130 ml of water are added in one portion and the product which precipitates is filtered off at room temperature, washed with water until neutral and dried. The product is recrystallised from N-methylpyrrolidone and 3.9 g of the compound of the formula (104)

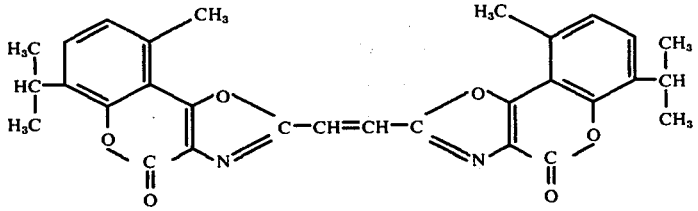

are obtained. Light yellow crystals of melting point 355° C (decomposition) after two recrystallisations from o-dichlorobenzene.

Analogously, 3-amino-4-hydroxy-coumarin and DL-malic acid give the compound of the formula (105)

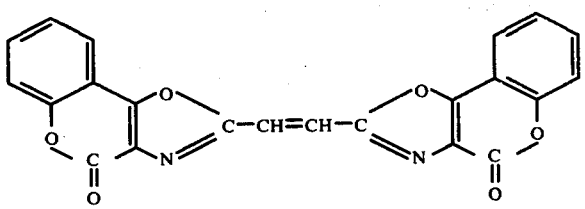

of melting point 400° C after boiling with dimethylformamide and high vacuum sublimation of a sample at 400° C.

The compounds of the general formula (106) listed in Table 1 can be manufactured in the same manner:

TABLE 1

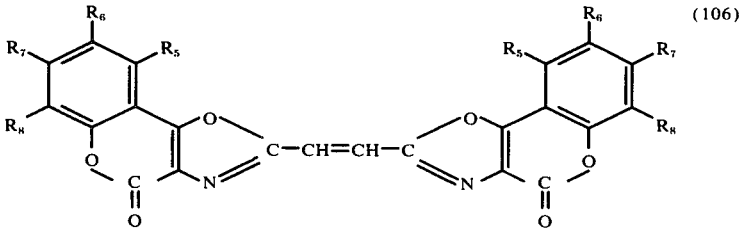

(106)

| Formula No. | $R_5$ | $R_6$ | $R_7$ | $R_8$ |
|---|---|---|---|---|
| 107 | H | $CH_3$ | H | H |
| 108 | H | H | $CH_3$ | H |
| 109 | H | H | H | $CH_3$ |
| 110 | H | t-butyl | H | H |
| 111 | H | $-O-CH_3$ | H | H |
| 112 | $CH_3$ | H | H | isopropyl |
| 113 | H | H | 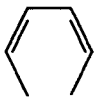 | |

EXAMPLE 4

8.9 g of 3-amino-4-hydroxy-coumarin and 12.2 g of the aldehyde of the formula

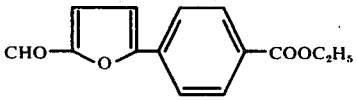

(114)

in 50 ml of dimethylformamide are heated to 100° C for 5 minutes. 5 ml of water are added, the mixture is cooled and the product which precipitates is filtered off and washed with methanol. 14.5 g of a red dyestuff of the formula

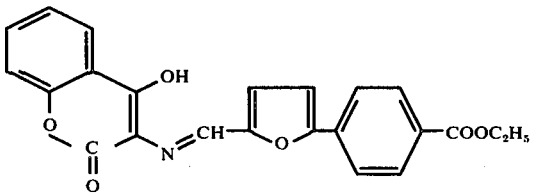

(115)

are obtained; the dyestuff has a melting point of 216° C and can be recrystallised from methylcellosolve.

13.7 g of this dyestuff and 17.6 g of 94% pure lead tetraacetate in 100 ml of glacial acetic acid are stirred for 15 minutes under reflux, during which the mixture rapidly becomes decolourised. After cooling to room temperature, the product which has precipitated is filtered off, washed with methanol and dried. 11.9 g of the compound of the formula

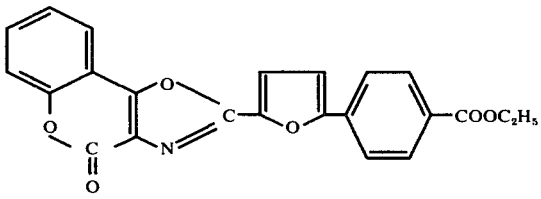

(116)

are obtained. Almost colourless to pale yellowish crystals of metling point 219° C after recrystallisation from methylcellosolve and chlorobenzene.

Analogously, biphenyl-4,4'-dialdehyde and 3-amino4-hydroxy-5,6-benzo-coumarin give the sparingly soluble compound of the formula (117)

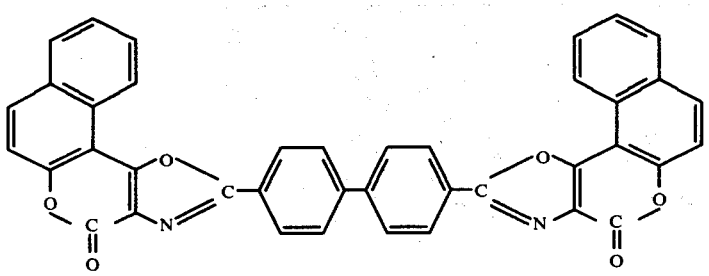

Melting point >400° C after extraction with boiling N-methylpyrrolidone.

EXAMPLE 5

The compounds of the general formula (118) and (132), listed respectively in Table 2 and 3, are obtained according to various methods, for example according to the methods of manufacture indicated in the last column in Table 2.

Acid amides which are sparingly soluble in dichlorobenzene can in general be cyclised more advantageously in higher-boiling solvents such as trichlorobenzene or chlorinated biphenyl (Aroclor 1221 of Monsanto), using phosphorus oxychloride and pyridine.

Method a. Dichlorobenzene
b. Trichlorobenzene
c. Aroclor 1221
d. Already cyclised in the 1st stage, in pyridine.

The resulting coumarino-3,4-oxazoles in most cases crystallise direct from the solvents used, on cooling, so that evaporation in vacuo is unnecessary. The carboxylic acids of the formulae (159) and (160) are obtained, for example, by saponifying the corresponding esters.

TABLE 2

(118)

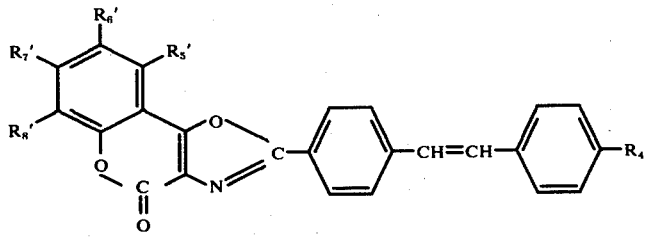

| Formula No. | $R_4$ | $R_5'$ | $R_6'$ | $R_7'$ | $R_8'$ | Melting point °C | Method of manufacture |
|---|---|---|---|---|---|---|---|
| 119 | H | H | H | H | H | 250 | Example 1a) |
| 120 | $-COOC_2H_5$ | $CH_3$ | H | H | isopropyl | 273 | Example 2) |
| 121 | $-COOC_2H_5$ | H | t-butyl | H | H | 276 | Example 2) |
| 122 | $-COOC_2H_5$ | H | $-O-CH_3$ | H | H | 281 | Example 1b) |
| 123 | $-COOC_2H_5$ | H | H | H | $CH_3$ | 286 | Example 1a) |
| 124 | $-COOC_2H_5$ | H | H | $CH_3$ | H | 237 | Example 1a) |
| 125 | $-COOC_2H_5$ | H | $CH_3$ | H | H | 282 | Example 1a) |
| 126 | $-CN$ | H | H | H | H | 355 | Example 2) |
| 127 | H | | | H | H | 304 | Example 1a) |
| 128 | H | H | H | | | 273 | Example 2) |
| 129 | $-CN$ | | | H | H | 360 | Example 1a) |
| 130 | | H | H | H | H | 330 | Example 1c) |
| 131 | $-SO_2CH_3$ | | | H | H | 353 | Example 1d) |

TABLE 3

(132)

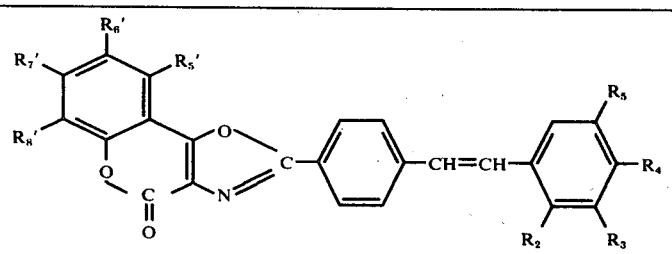

| Formula No. | $R_2$ | $R_3$ | $R_4$ | $R_5$ | $R_5'$ | $R_6'$ | $R_7'$ | $R_8'$ |
|---|---|---|---|---|---|---|---|---|
| 133 | $-CH_3$ | H | H | H | H | H | H | H |
| 134 | H | $-CH_3$ | H | H | H | H | H | H |
| 135 | H | H | $-CH_3$ | H | H | H | H | H |
| 136 | $-CN$ | H | H | H | | | H | H |
| 137 | H | $-CN$ | H | H | H | H | H | H |
| 138 | $-COOCH_3$ | H | H | H | | | H | H |
| 139 | H | $-COOCH_3$ | H | H | H | H | H | H |
| 140 | H | H | $-COOCH_3$ | H | $CH_3$ | H | H | isopropyl |
| 141 | $-OCH_3$ | H | H | H | H | H | H | H |
| 142 | H | $-OCH_3$ | H | H | H | H | H | H |
| 143 | H | H | $-OCH_3$ | H | H | H | H | H |
| 144 | Cl | H | H | H | | | H | H |
| 145 | H | Cl | H | H | H | H | H | H |
| 146 | H | H | Cl | H | | | H | H |
| 147 | $-CH_3$ | H | $-COOCH_3$ | H | H | H | H | H |
| 148 | H | H | $-CONH_2$ | H | H | H | H | H |
| 149 | Cl | H | $-CH_3$ | H | H | H | $CH_3$ | H |
| 150 | H | H | $-SO_2-C_2H_5$ | H | | | H | H |
| 151 | H | H | $-SO_2-$n-propyl | H | H | H | H | H |
| 152 | H | H | $-SO_2-$ | H | H | H | H | H |
| 153 | H | H | $-SO_2-CH_2-$ | H | H | H | H | H |
| 154 | H | H | $-SO_2$-isobutyl | H | H | H | H | H |
| 155 | $-SO_2CH_3$ | H | H | H | | | H | H |
| 156 | H | Cl | $-CH_3$ | H | H | H | H | H |
| 157 | Cl | H | Cl | Cl | | | H | H |
| 158 | H | Cl | Cl | H | H | H | H | H |
| 159 | H | H | $-COOH$ | H | H | H | H | H |
| 160 | $-COOH$ | H | H | H | | | H | H |
| 161 | H | H | $-COO-CH(CH_3)_2$ | H | H | H | H | H |
| 162 | $-CH_3$ | H | H | $-CH_3$ | H | H | H | H |
| 163 | $-C_2H_5$ | H | $-C_2H_5$ | H | H | H | H | H |

TABLE 3 – continued (132)

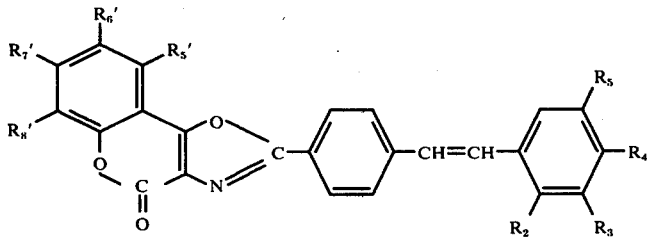

| Formula No. | $R_2$ | $R_3$ | $R_4$ | $R_5$ | $R_5'$ | $R_6'$ | $R_7'$ | $R_8'$ |
|---|---|---|---|---|---|---|---|---|
| 164 | $-OCH_3$ | H | H | $-OCH_3$ | H | H | H | H |
| 165 | $-CH_3$ | H | $-CH_3$ | H | H | H | H | H |
| 166 | H | $-OCH_3$ | H | $-OCH_3$ | H | H | H | H |
| 167 | $-CH_3$ | $-CH_3$ | $-CH_3$ | H | H | H | H | H |
| 168 | $-CH_3$ | H | $-CH_3$ | $-CH_3$ | H | H | H | H |
| 169 | $-OCH_3$ | H | $-OCH_3$ | H | H | H | H | H |
| 170 | $-OCH_3$ | $-OCH_3$ | $-OCH_3$ | H | H | H | H | H |
| 171 | $-OCH_3$ | H | $-OCH_3$ | $-OCH_3$ | H | H | H | H |
| 172 | H | H | Br | H | H | H | H | H |
| 173 | H | H | F | H | H | H | H | H |
| 174 | $-OCH_3$ | $-OCH_3$ | H | H | H | H | H | H |
| 175 | $-Cl$ | H | H | Cl | | | H | H |
| 176 | H | H | t-butyl | H | H | H | H | H |
| 177 | $-Cl$ | H | Cl | H | H | H | H | H |
| 178 | H | H | $-CON(CH_3)_2$ | H | H | H | H | H |
| 179 | H | $-OCH_3$ | $-OCH_3$ | H | H | H | H | H |
| 180 | H | H | $-SO_2N(CH_3)_2$ | H | H | H | H | H |
| 181 | H | H | isopropyl | H | H | H | H | H |

EXAMPLE 6

The stilbenyl derivatives of the general formula (182) listed in Table 4 can be manufactured analogously to the method mentioned in Example 4.

TABLE 4

(182)

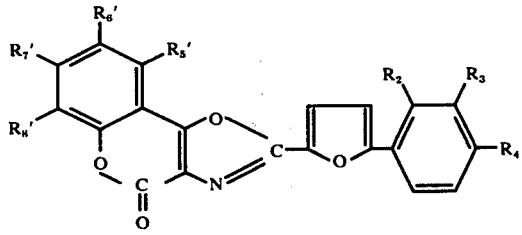

| Formula No. | $R_2$ | $R_3$ | $R_4$ | $R_5'$ | $R_6'$ | $R_7'$ | $R_8'$ |
|---|---|---|---|---|---|---|---|
| 183 | H | H | H | H | H | H | H |
| 184 | H | H | $-Cl$ | H | H | H | H |
| 185 | H | H | $-CH_3$ | H | H | H | H |
| 186 | H | Cl | $-Cl$ | H | H | H | H |
| 187 | H | H | $-COOCH_3$ | H | H | H | H |
| 188 | H | H | $-COOC_2H_5$ | | | H | H |
| 189 | H | H | $-SO_2CH_3$ | H | H | H | H |
| 190 | H | H | $-SO_2C_2H_5$ | H | H | H | H |
| 191 | H | H | $-CN$ | H | H | H | H |
| 192 | Cl | H | $-Cl$ | H | H | H | H |
| 193 | H | H | $-CN$ | $CH_3$ | H | H | isopropyl |
| 194 | H | H | $-COOC_2H_5$ | H | t-butyl | H | H |
| 195 | H | H | $-CN$ | H | H | $CH_3$ | H |

TABLE 4-continued (182)

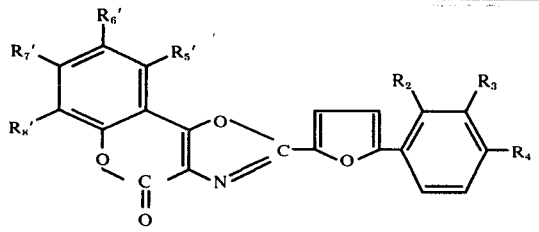

| Formula No. | $R_2$ | $R_3$ | $R_4$ | $R_5'$ | $R_6'$ | $R_7'$ | $R_8'$ |
|---|---|---|---|---|---|---|---|
| 196 | Cl | H | Cl | H | $OCH_3$ | H | H |
| 197 | H | H | Cl | 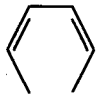 | | H | H |

chloride (even without perchloroethylene), the compound of the formula (198)

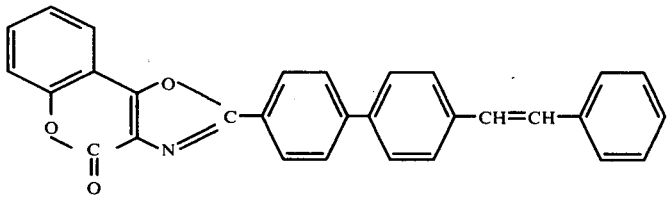

EXAMPLE 7

If in Example 1, instead of stilbene-4-carboxylic acid 4'-carboxylic acid ethyl ester, 4-stilbenyl-benzoic acid (DAS 1,594,822) is used, which can be converted into the acid chloride by boiling for four hours in thionyl chloride (even without perchloroethylene), the compound of the formula (198)

is obtained. Pale yellow crystals, melting point 318° C, after recrystallisation from dimethylformamide and dichlorobenzene.

The 4-stilbenylphenyl derivatives of the general formula (199)

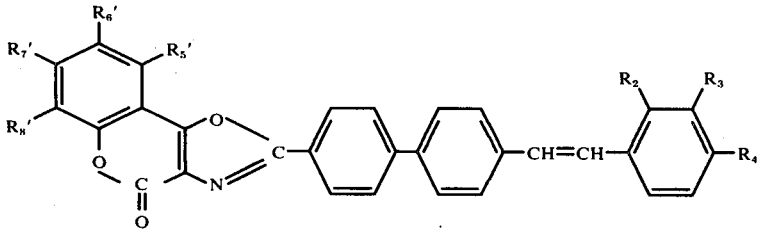

listed in Table 5 are obtained analogously.

TABLE 5

| Formula No. | $R_2$ | $R_3$ | $R_4$ | $R_5'$ | $R_6'$ | $R_7'$ | $R_8'$ |
|---|---|---|---|---|---|---|---|
| 200 | H | H | H | $CH_3$ | H | H | H |
| 201 | H | H | H | H | $CH_3$ | H | H |
| 202 | H | H | H | H | H | $CH_3$ | H |
| 203 | H | H | H | H | H | H | $CH_3$ |
| 204 | H | H | H | $CH_3$ | H | H | isopropyl |
| 205 | H | H | H | H | t-butyl | H | H |
| 206 | H | H | H | H | $-OCH_3$ | H | H |
| 207 | H | H | H | 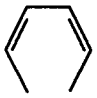 | | H | H |
| 208 | H | H | H | H | H | 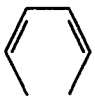 | |
| 209 | H | H | $-COOCH_3$ | H | H | | H |
| 210 | H | H | -COO- | H | H | H | H |

TABLE 5-continued

| Formula No. | $R_2$ | $R_3$ | $R_4$ | $R_5'$ | $R_6'$ | $R_7'$ | $R_8'$ |
|---|---|---|---|---|---|---|---|
| 211 | H | H | isopropyl —COO-n-butyl | H | H | H | H |
| 212 | Cl | H | H | H | H | H | H |
| 213 | H | Cl | H | H | H | H | H |
| 214 | H | H | Cl | H | H | H | H |
| 215 | $-OCH_3$ | H | H | H | H | H | H |
| 216 | H | $-OCH_3$ | H | H | H | H | H |
| 217 | H | H | $-OCH_3$ | H | H | H | H |
| 218 | H | H | $-CH_3$ | H | H | H | H |
| 219 | —CN | H | H | H | H | H | H |
| 220 | H | H | —CN | H | H | H | H |
| 221 | $-SO_2CH_3$ | H | H | H | H | H | H |

EXAMPLE 8

The styryl derivatives of the general formula

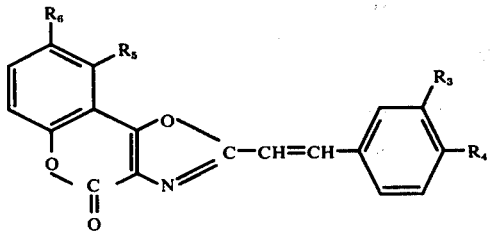

(222)

listed in Table 6 can be prepared analogously to Example 1 or 2.

TABLE 6

| Formula No. | $R_3$ | $R_4$ | $R_5$ | $R_6$ | Melting point ° C | Method of manufacture |
|---|---|---|---|---|---|---|
| 223 | H | —CN | H | H | 312 | Example 1 |
| 224 | H | $-COOC_2H_5$ | H | H | 223 | Example 1 |
| 225 | H | —CN | 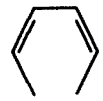 | | 360 | Example 1 |
| 226 | H | H | 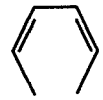 | | 227 | Example 1 |
| 227 | H | $-OCH_3$ | H | H | 246 | Example 1 |
| 228 | 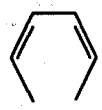 | | H | H | 245 | Example 2 |

The styryl derivatives of the general formula (229) listed in Table 7 can be manufactured analogously.

TABLE 7

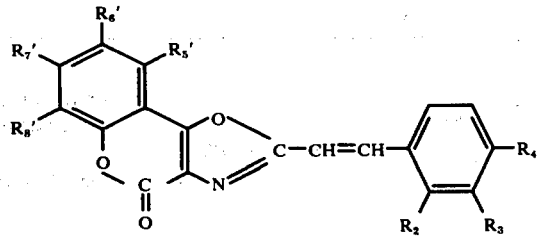

(229)

| Formula No. | $R_2$ | $R_3$ | $R_4$ | $R_5'$ | $R_6'$ | $R_7'$ | $R_8'$ |
|---|---|---|---|---|---|---|---|
| 230 | H | H | $-COOCH_3$ | H | H | H | H |
| 231 | H | H | $-COOC_2H_5$ | $CH_3$ | H | H | isopropyl |
| 232 | H | H | $-COOC_2H_5$ | H | t-butyl | H | H |
| 233 | H | H | $-COOC_2H_5$ | H | $-OCH_3$ | H | H |
| 234 | H | H | $-COOC_2H_5$ | H | $-CH_3$ | H | H |
| 235 | H | H | $-COOC_2H_5$ | H | H | $CH_3$ | H |
| 236 | H | H | $-COOC_2H_5$ | H | H | H | $CH_3$ |

TABLE 7-continued

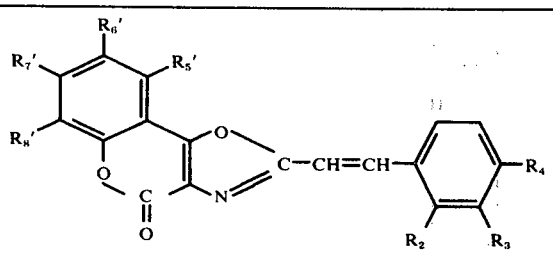

(229)

| Formula No. | $R_2$ | $R_3$ | $R_4$ | $R_5'$ | $R_6'$ | $R_7'$ | $R_8'$ |
|---|---|---|---|---|---|---|---|
| 237 | H | H | $-COOC_2H_5$ | | | H | H |
| 238 | H | H | $-COO-NC_4H_9$ | | | H | H |
| 239 | H | H | $-COO(CH_2)_2OC_2H_5$ | | | H | H |
| 240 | H | H | $-COO-C_6H_5$ | | | H | H |
| 241 | H | H | $-COO-C_6H_5-H$ | | | H | H |
| 242 | H | H | $-COO-CH_2-C_6H_5$ | | | H | H |
| 243 | $-COOCH_3$ | H | H | | | H | H |
| 244 | $-CN$ | H | H | | | H | H |
| 245 | H | H | $-CO-NH-CH_3$ | H | H | H | H |
| 246 | H | H | $-CO-N(C_2H_5)_2$ | H | H | H | H |
| 247 | H | H | $-CO-N$ (morpholine) | H | H | H | H |
| 248 | H | Cl | $-CN$ | H | H | H | H |
| 249 | H | H | $-C_6H_5$ | H | H | H | H |

EXAMPLE 9

An intimate mixture of 11.9 g of the compound of the formula

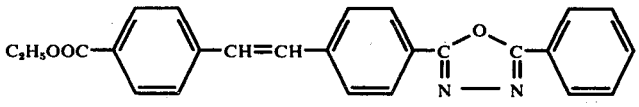

(250)

(melting point 181° to 183° C, DAS 1,294,917, manufacturing instruction F) and 5.4 g of 3-amino-4-hydroxy-coumarin in 100 g of polyphosphoric acid is stirred under nitrogen at 80°, the temperature is raised to 200° C and the mixture is kept for a further hour at this temperature. After cooling to about 80° C, 150 ml of water are added in one portion. The product which precipitates is filtered at room temperature, washed with water until neutral and dried in vacuo at 100° C. The resulting product is boiled in 80 ml of dimethylformamide, filtered off at room temperature and dried. 5.8 g of the compound of the formula (251)

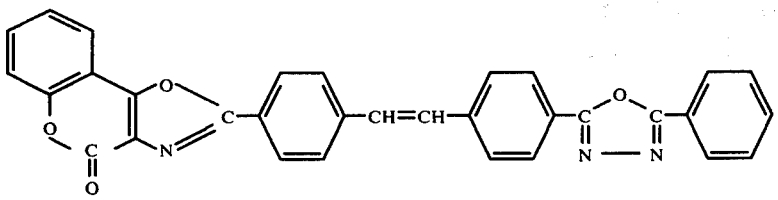

are obtained. Light yellow crystals of melting point 318° C after recrystallisation from N-methylpyrrolidone, dodecylbenzene and trichlorobenzene.

The oxdiazole derivatives of the general formula (252) listed in Table 8 can be manufactured analogously.

EXAMPLE 10

In a similar manner to that described in Example 3, 3-amino-4-hydroxy-coumarin and naphthalene-2,6-dicarboxylic acid dimethyl ester at a temperature of 200° C, and within a reaction time of about 1 hour, give the compound of the formula (271)

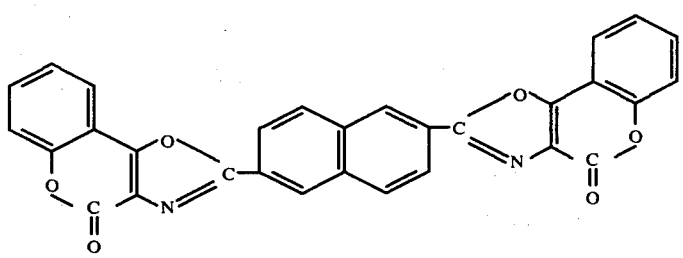

Melting point >400° C after boiling with dimethylformamide and high vacuum sublimation at 400° to 450° C.

The naphthalene-2,6 derivatives of the general formula

TABLE 8

(252)

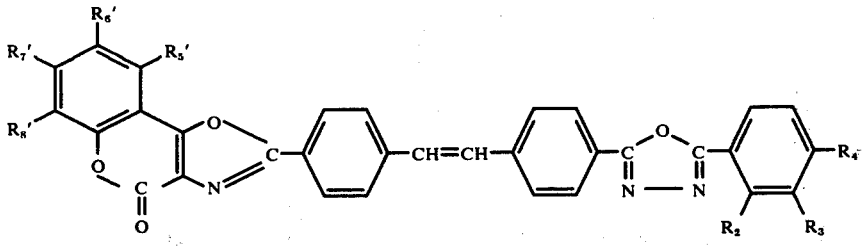

| Formula No. | $R_2$ | $R_3$ | $R_4$ | $R_5'$ | $R_6'$ | $R_7'$ | $R_8'$ |
|---|---|---|---|---|---|---|---|
| 253 | $CH_3$ | H | H | H | H | H | H |
| 254 | H | $CH_3$ | H | H | H | H | H |
| 255 | H | H | $CH_3$ | H | H | H | H |
| 256 | Cl | H | H | H | H | H | H |
| 257 | H | Cl | H | H | H | H | H |
| 258 | H | H | Cl | H | H | H | H |
| 259 | H | H | t-butyl | H | H | H | H |
| 260 | H | $OCH_3$ | H | H | H | H | H |
| 261 | H | H | $OCH_3$ | H | H | H | H |
| 262 | H | H | $C_6H_5$ | H | H | H | H |
| 263 | H | H | $COOC_2H_5$ | H | H | H | H |
| 264 | H | $CH_3$ | $CH_3$ | H | H | H | H |
| 265 | H | H | H | $CH_3$ | H | H | isopropyl |
| 266 | H | H | H | H | $CH_3$ | H | H |
| 267 | H | H | H | H | H | $CH_3$ | H |
| 268 | H | H | H | H | H | H | $CH_3$ |
| 269 | H | H | H | H | isobutyl | H | H |
| 270 | H | H | H | | | H | H |

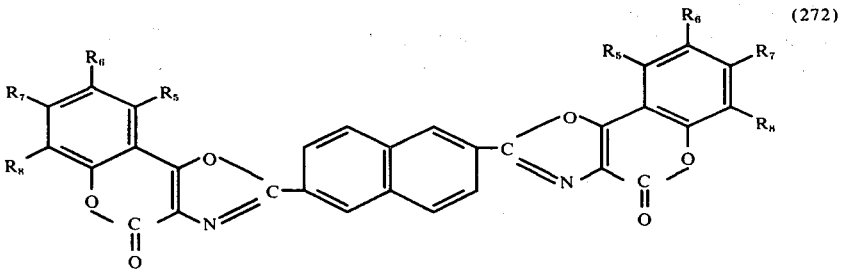

(272)

listed in Table 9 are obtained in the same manner.

TABLE 9

| Formula No. | $R_5$ | $R_6$ | $R_7$ | $R_8$ |
|---|---|---|---|---|
| 273 | $CH_3$ | H | H | isopropyl |
| 274 | H | t-butyl | H | H |
| 275 | H | $CH_3$ | H | H |
| 276 | H | H | $CH_3$ | H |
| 277 | H | H | H | $CH_3$ |

EXAMPLE 11

The stilbenes of the general formula

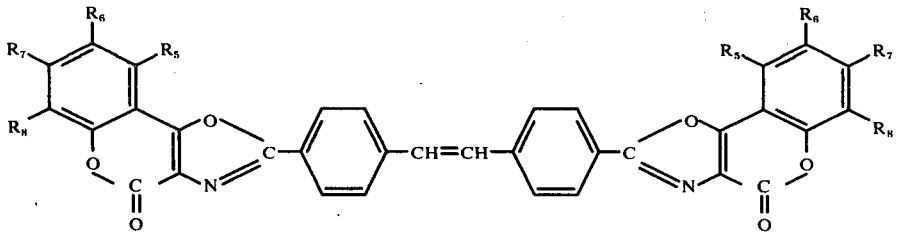

(278)

listed in Table 10 can be manufactured in accordance with Example 1 or 2 using the method indicated in Example 5.

TABLE 10

| Formula No. | $R_5$ | $R_6$ | $R_7$ | $R_8$ | Melting point ° C | Method of manufacture |
|---|---|---|---|---|---|---|
| 279 | $CH_3$ | H | H | isopropyl | >400 | Example 2 |
| 280 | H | t-butyl | H | H | >400 | Example 1b) |
| 281 | H | H | H | $CH_3$ | >400 | Example lb) |

The stilbenes of the general formula (278) listed in Table 11 are obtained analogously.

TABLE 11

| Formula No. | $R_5$ | $R_6$ | $R_7$ | $R_8$ |
|---|---|---|---|---|
| 282 | H | $CH_3$ | H | H |
| 283 | H | H | $CH_3$ | H |
| 284 | H | H | H | $CH_3$ |
| 285 | | | H | H |
| 286 | H | $OCH_3$ | H | H |

EXAMPLE 12

3-Amino-4-hydroxy-coumarin and naphthalene-1,4-dicarboxylic acid dichloride give, analogously to Example 2, the compound of the formula

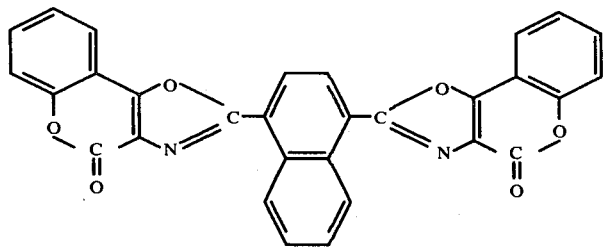

(287)

Melting point >400° C after boiling with N-methylpyrrolidone, high vacuum sublimation at 400° C and recrystallisation from chlorinated biphenyl.

The naphthalene-1,4 derivatives of the general formula

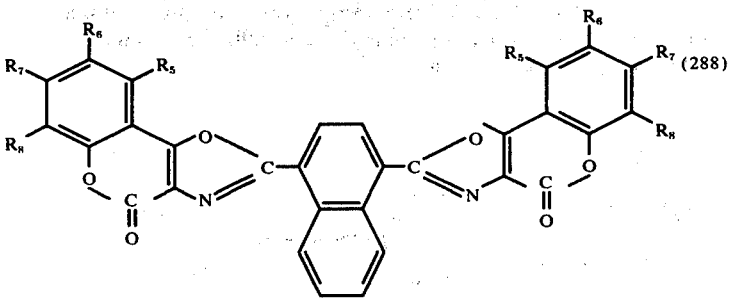

(288)

listed in Table 12 can be manufactured in accordance with the methods described in Examples 1 or 2.

TABLE 12

| Formula No. | $R_5$ | $R_6$ | $R_7$ | $R_8$ |
|---|---|---|---|---|
| 289 | $-CH_3$ | H | H | isopropyl |
| 290 | H | $-CH_3$ | H | H |
| 291 | H | H | $-CH_3$ | H |
| 292 | H | t-butyl | H | H |
| 293 | H | $-OCH_3$ | H | H |
| 294 | 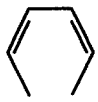 | | H | H |

EXAMPLE 13

6-Methoxy-coumarilic acid is reacted with 3-amino-4-hydroxy-coumarin according to Example 1. The compound of the formula

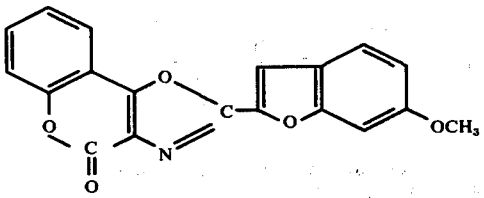

(295)

is obtained. Pale yellow crystals, melting point 260° C (after recrystallisation from dimethylformamide and o-dichlorobenzene).

If instead of 3-amino-4-hydroxy-coumarin, 3-amino-4-hydroxy-5,6-benzocoumarin is used, the compound of the formula

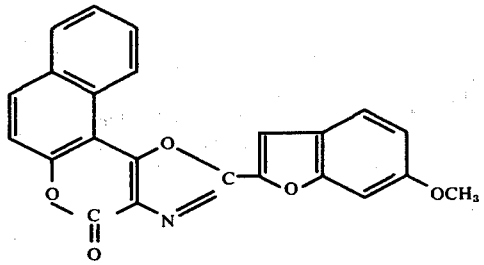

(296)

is obtained. Melting point 314° C after recrystallisation from N-methylpyrrolidone and o-dichlorobenzene.

The benzofurane derivatives of the general formula

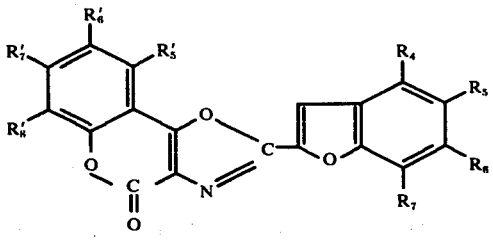

(297)

listed in Table 13 can be manufactured analogously.

TABLE 13

| Formula No. | $R_5'$ | $R_6'$ | $R_7'$ | $R_8'$ | $R_3$ | $R_4$ | $R_5$ | $R_6$ | $R_7$ |
|---|---|---|---|---|---|---|---|---|---|
| 298 | $CH_3$ | H | H | isopropyl | H | H | H | $OCH_3$ | H |
| 299 | H | $CH_3$ | H | H | H | H | H | $OCH_3$ | H |
| 300 | H | H | $CH_3$ | H | H | H | H | $OCH_3$ | H |
| 301 | H | H | H | $CH_3$ | H | H | H | $OCH_3$ | H |
| 302 | H | t-butyl | H | H | H | H | H | $OCH_3$ | H |
| 303 | H | $OCH_3$ | H | H | H | H | H | $OCH_3$ | H |
| 304 | H | H | 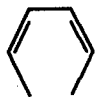 | | H | H | H | $OCH_3$ | H |
| 305 | H | H | H | H | H | 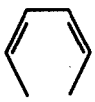 | | H | H |
| 306 | H | H | H | H | H | H | Cl | H | Cl |
| 307 | H | H | H | H | $CH_3$ | H | H | $OCH_3$ | H |
| 308 | H | H | H | H | $C_6H_5$ | H | H | $OCH_3$ | H |

EXAMPLE 14

4.7 g of furane-2,5-dicarboxylic acid are reacted analogously to Example 1 (method of Example 5b), via the dicarboxylic acid dichloride, with 10.6 g of 3-amino-4-hydroxy-coumarin. 8.1 g of the compound of the formula

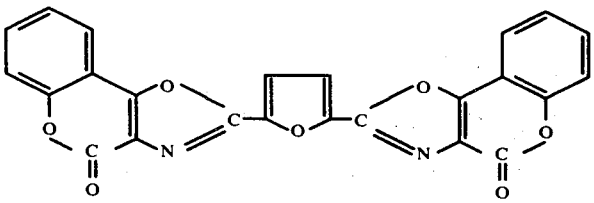

(309)

are obtained. Melting point >400° C after two recrystallisations from N-methylpyrrolidone.

Similarly (Example 1, method of Example 5c), thiophene-2,5-dicarboxylic acid or 4-carboxy-cinnamic acid respectively give the compounds of the formulae

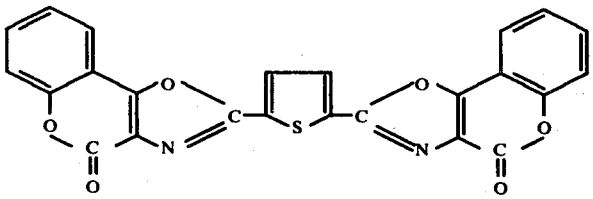

(310)

Melting point >400° C (after boiling in N-methylpyrrolidone and trichlorobenzene and high vacuum sublimation at 400° C and recrystallisation from chlorinated biphenyl) or

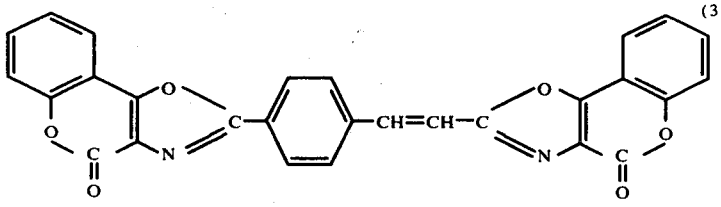

(311)

Melting point >400° C (after boiling in dimethylformamide, high vacuum sublimation at 400° to 410° C and recrystallisation from chlorinated biphenyl).

The compounds listed in Table 14, of the general formula

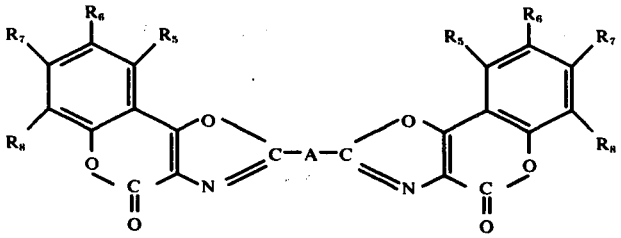

(312)

can be manufactured analogously to the description in Example 1, 2, 3 and 4.

TABLE 14

| Formula No. | A | $R_5$ | $R_6$ | $R_7$ | $R_8$ |
|---|---|---|---|---|---|
| 313 | 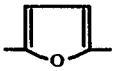 | $CH_3$ | H | H | isopropyl |
| 314 | 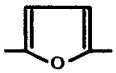 | H | t-butyl | H | H |
| 315 | 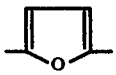 | H | H | $CH_3$ | H |

TABLE 14-continued
| Formula No. | A | $R_5$ | $R_6$ | $R_7$ | $R_8$ |
|---|---|---|---|---|---|
| 316 | 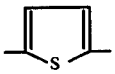 | $CH_3$ | H | H | isopropyl |
| 317 | 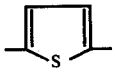 | H | t-butyl | H | H |
| 318 | 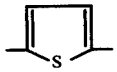 | H | H | $CH_3$ | H |
| 319 | 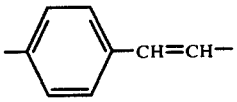 | $CH_3$ | H | H | isopropyl |
| 320 | 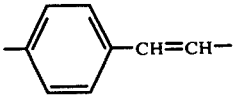 | H | t-butyl | H | H |
| 321 | 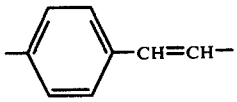 | H | H | $CH_3$ | H |
| 322 | 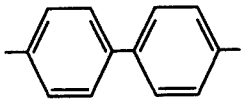 | $CH_3$ | H | H | isopropyl |
| 323 | 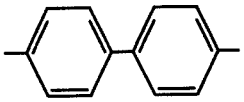 | H | t-butyl | H | H |
| 324 | 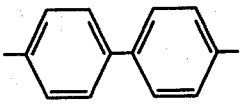 | H | H | $CH_3$ | H |
| 325 | 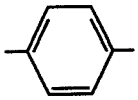 | $CH_3$ | H | H | isopropyl |
| 326 | 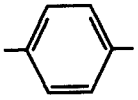 | H | t-butyl | H | H |
| 327 | 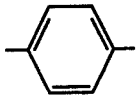 | H | H | $CH_3$ | H |
| 328 | 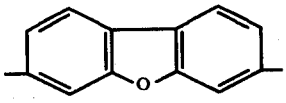 | $CH_3$ | H | H | isopropyl |
| 329 | 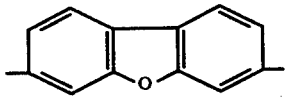 | H | t-butyl | H | H |
| 330 | 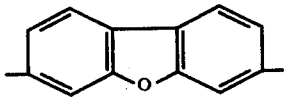 | H | H | $CH_3$ | H |
| 331 | 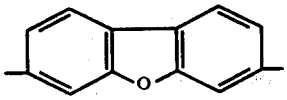 | 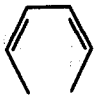 | | H | H |
| 332 | 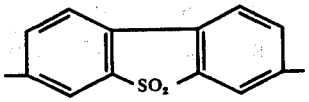 | H | t-butyl | H | H |

TABLE 14-continued

| Formula No. | A | $R_5$ | $R_6$ | $R_7$ | $R_8$ |
|---|---|---|---|---|---|
| 333 | 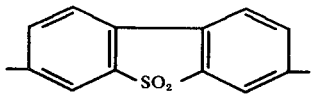 | $CH_3$ | H | H | isopropyl |
| 334 | 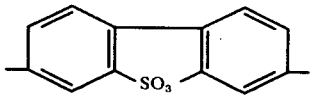 | H | H | $CH_3$ | H |
| 335 | 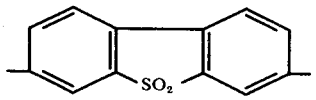 | 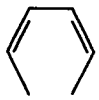 | | H | H |
| 336 | 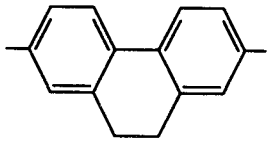 | $CH_3$ | H | H | isopropyl |
| 337 | 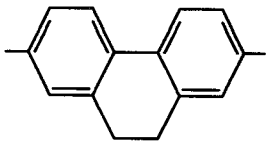 | H | t-butyl | H | H |

EXAMPLE 15

12.2 g of 2-phenylthiophene-5-carboxylic acid are reacted analogously to Example 1, via the acid chloride, with 11.1 g of 3-amino-4-hydroxy-coumarin to give the compound of the formula

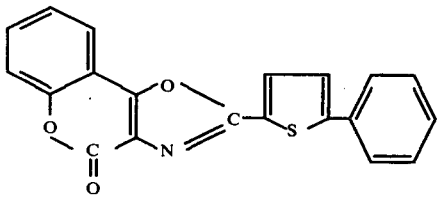

(338)

Melting point 242° C after recrystallisation from methylcellosolve and chlorobenzene.

The compounds of the general formulae (339) and (351) listed in Table 15 and 16 can be manufactured in a similar manner.

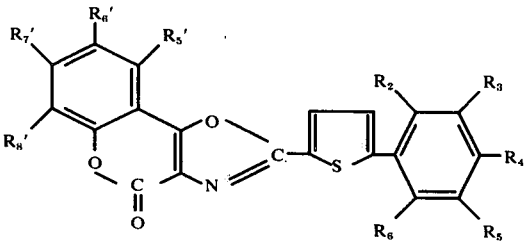

(339)

TABLE 15

| Formula No. | $R_2$ | $R_3$ | $R_4$ | $R_5$ | $R_6$ | $R_5'$ | $R_6'$ | $R_7'$ | $R_8'$ |
|---|---|---|---|---|---|---|---|---|---|
| 340 | Cl | H | H | Cl | H | H | H | H | H |
| 341 | $CH_3$ | H | Cl | H | H | H | H | H | H |
| 342 | H | H | Cl | H | H | H | H | H | H |
| 343 | H | H | $OCH_3$ | H | H | H | H | H | H |
| 344 | H | H | $CH_3$ | H | H | H | H | H | H |
| 345 | $OCH_3$ | H | Cl | H | $OCH_3$ | H | H | H | H |
| 346 | H | Cl | Cl | H | H | H | H | H | H |
| 347 | H | H | H | H | H | $CH_3$ | H | H | isopropyl |
| 348 | H | H | H | H | H | H | t-butyl | H | H |
| 349 | H | H | H | H | H | H | H | $CH_3$ | H |

TABLE 15-continued

| Formula No. | $R_2$ | $R_3$ | $R_4$ | $R_5$ | $R_6$ | $R_5'$ | $R_6'$ | $R_7'$ | $R_8'$ |
|---|---|---|---|---|---|---|---|---|---|
| 350 | H | H | H | H | H | | | H | H |

TABLE 16

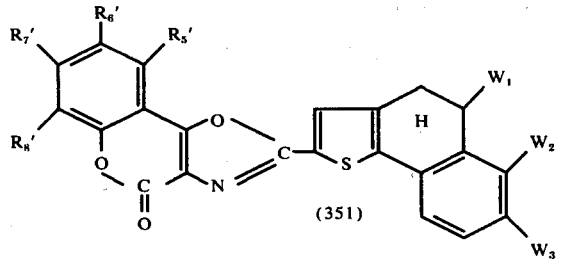

(351)

| Formula No. | $W_1$ | $W_2$ | $W_3$ | $R_5'$ | $R_6'$ | $R_7'$ | $R_8'$ |
|---|---|---|---|---|---|---|---|
| 352 | H | H | H | H | H | H | H |
| 353 | $CH_3$ | H | H | H | H | H | H |
| 354 | H | H | $CH_3$ | H | H | H | H |
| 355 | H | Cl | H | H | H | H | H |
| 356 | H | H | H | $CH_3$ | H | H | isopropyl |
| 357 | H | H | H | H | t-butyl | H | H |
| 358 | H | H | H | H | H | $CH_3$ | H |
| 359 | H | H | H | | | H | H |

EXAMPLE 16

5.9 g of pyrene-3-carboxylic acid are reacted analogously to Example 1, via the acid chloride, with 4.5 g of 3-amino-4-hydroxy-courmarin. The compound of the formula

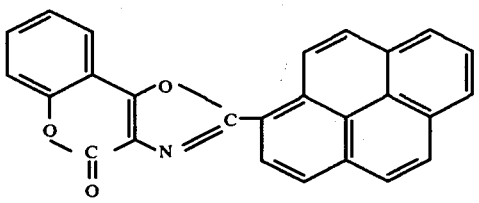

(360)

is obtained. Melting point 318° C after recrystallisation from dimethylformamide and o-dichlorobenzene.

The pyrene derivatives of the general formula

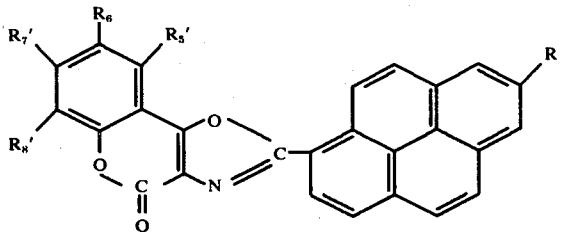

listed in Table 17 can be manufactured in a similar manner.

TABLE 17

| Formula No. | R | $R_5'$ | $R_6'$ | $R_7'$ | $R_8'$ |
|---|---|---|---|---|---|
| 362 | H | $CH_3$ | H | H | isopropyl |
| 363 | H | H | t-butyl | H | H |
| 364 | H | H | H | $CH_3$ | H |
| 365 | t-butyl | H | H | H | H |

EXAMPLE 17

The compounds of the general formula (366) listed in Table 18 and the compound of the formula (375) can be prepared analogously to Example 1 or 5.

TABLE 18

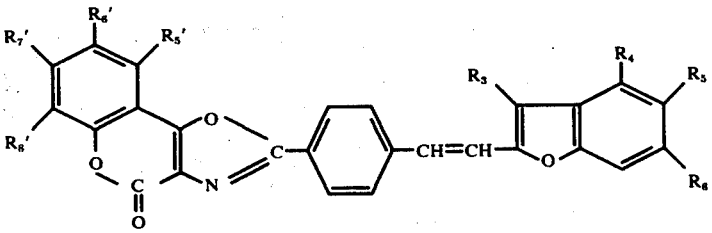

(366)

| Formula No. | $R_3$ | $R_4$ | $R_5$ | $R_6$ | $R_5'$ | $R_6'$ | $R_7'$ | $R_8'$ |
|---|---|---|---|---|---|---|---|---|
| 367 | H | H | H | H | H | H | H | H |
| 368 | $CH_3$ | H | H | H | H | H | H | H |
| 369 | H | H | H | $CH_3$ | H | H | H | H |

TABLE 18-continued (366)

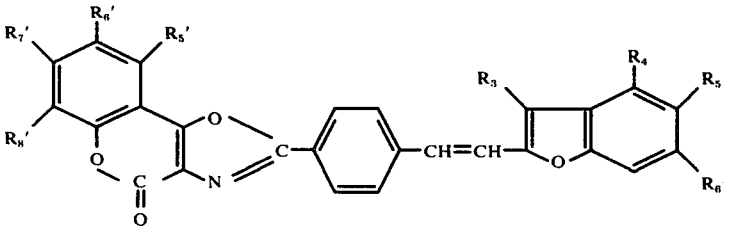

| Formula No. | $R_3$ | $R_4$ | $R_5$ | $R_6$ | $R_5'$ | $R_6'$ | $R_7'$ | $R_8'$ |
|---|---|---|---|---|---|---|---|---|
| 370 | H | | | H | H | H | H | H |
| 371 | H | H | H | H | H | t-butyl | H | H |
| 372 | H | H | H | H | H | H | $CH_3$ | H |
| 373 | H | H | H | H | H | H | H | $CH_3$ |
| 374 | H | H | H | H | | | H | H |
| 375 | | | | | | | | |

EXAMPLE 18

The compounds of the general formula (376)

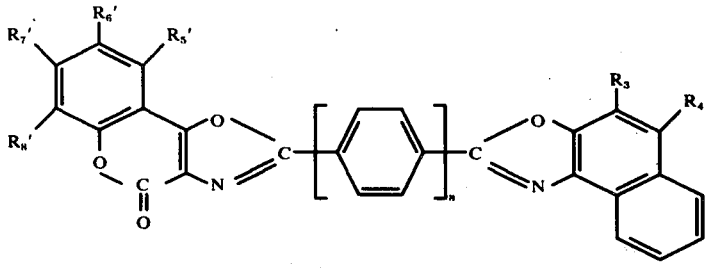

listed in Table 19 are obtained analogously to Example 1, 2 or 4.

TABLE 19

| Formula No. | n | $R_3$ | $R_4$ | $R_5'$ | $R_6'$ | $R_7'$ | $R_8'$ |
|---|---|---|---|---|---|---|---|
| 377 | 1 | H | H | H | H | H | H |
| 378 | 1 | CN | H | H | H | H | H |
| 379 | 1 | H | H | | | H | H |
| 380 | 1 | COOH | H | | | H | H |
| 381 | 1 | $COOCH_3$ | H | | | H | H |

TABLE 19-continued

| Formula No. | n | $R_3$ | $R_4$ | $R_5'$ | $R_6'$ | $R_7'$ | $R_8'$ |
|---|---|---|---|---|---|---|---|
| 382 | 1 | COO-n-$C_4H_9$ | H | | | H | H |
| 383 | 1 | | | | | H | H |
| 384 | 2 | H | H | H | H | H | H |
| 385 | 2 | CN | H | H | H | H | H |
| 386 | 2 | H | H | | | H | H |
| 387 | 2 | COOH | H | | | H | H |

TABLE 19-continued

| Formula No. | n | $R_3$ | $R_4$ | $R_5'$ | $R_6'$ | $R_7'$ | $R_8'$ |
|---|---|---|---|---|---|---|---|
| 388 | 2 | $COOCH_3$ | H | | | H | H |
| 389 | 2 | COO-n-$C_4H_9$ | H | | | H | H |
| 390 | 2 | | | | | H | H |

TABLE 19-continued

| Formula No. | n | $R_3$ | $R_4$ | $R_5'$ | $R_6'$ | $R_7'$ | $R_8'$ |
|---|---|---|---|---|---|---|---|
| 391 | 2 | H | H | $CH_3$ | H | H | isopropyl |
| 392 | 2 | H | H | H | H | $CH_3$ | H |

EXAMPLE 19

Analogously to Example 1, 2 or 3 it is possible to manufacture, from 4-triazolyl-stilbene-4'-carboxylic acid derivatives [Nippon Chem. DOS 2,010,764; Nisso Kako JA 13,148-66, priority 4.2.62; JA 1,445-69, priority 23.1.64] the corresponding naphthotriazoles, benzotriazoles or triazoles of the general formulae (393) or (402), listed in Table 20 and 21.

TABLE 20

(393)

| Formula No. | X | $R_1$ | $R_2$ | $R_5'$ | $R_6'$ | $R_7'$ | $R_8'$ |
|---|---|---|---|---|---|---|---|
| 394 | CN | H | H | H | H | H | H |
| 395 | CN | $-CH_2-CH_2-$ | | H | H | H | H |
| 396 | H | H | H | H | H | H | H |
| 397 | $SO_2CH_3$ | H | H | H | H | H | H |
| 398 | $SO_2C_2H_5$ | H | H | H | H | H | H |
| 399 | CN | H | H | $CH_3$ | H | H | isopropyl |
| 400 | CN | H | H | H | t-butyl | H | H |
| 401 | CN | H | H | H | H | $CH_3$ | H |

TABLE 21

(402)

| Formula No. | X | $R_4$ | $R_5$ | $R_5'$ | $R_6'$ | $R_7'$ | $R_8'$ |
|---|---|---|---|---|---|---|---|
| 403 | CN | $H_3C$ | $OCH_3$ | H | H | H | H |
| 404 | CN | $H_3C$ | $OC_2H_5$ | $CH_3$ | H | H | H |
| 405 | CN | $H_3C$ | $OC_4H_9$ | H | H | H | H |

TABLE 21-continued

| | | | | | | | |
|---|---|---|---|---|---|---|---|
| 406 | CN | $CH_3O$ | $OCH_3$ | H | H | H | H |
| 407 | CN | H | $C_6H_5$ | H | H | H | H |
| 408 | CN | Cl | $C_6H_5$ | H | H | H | H |
| 409 | CN | H | $-CH=CH-C_6H_5$ | H | H | H | H |
| 410 | CN | $-COOC_2H_5$ | $C_6H_5$ | H | H | H | H |
| 411 | CN | $CH_3$ | $C_6H_5$ | H | H | H | H |
| 412 | CN | CN | $C_6H_5$ | H | H | H | H |
| 413 | CN | H | $C_6H_5$ | $CH_3$ | H | H | iso-propyl |
| 414 | CN | H | $C_6H_5$ | H | t-butyl | H | H |
| 415 | CN | H | $C_6H_5$ | H | H | $CH_3$ | H |
| 416 | $SO_2CH_3$ | H | $C_6H_5$ | H | H | H | H |

EXAMPLE 20

The triazoles of the general formula

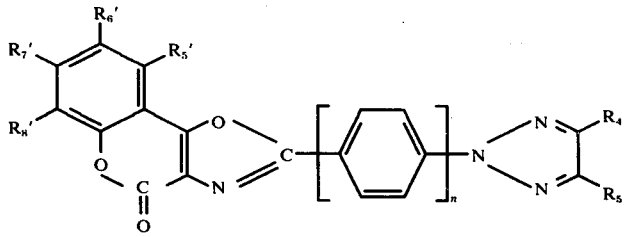

(417)

listed in Table 22 can be manufactured analogously to Example 1, 2 or 3 from 4-arotriazolyl-benzoic acid derivatives or 4-arotriazolyl-biphenyl-4'-carboxylic acid derivatives (DAS 2,030,010).

TABLE 22

| Formula No. | n | $R_4$ | $R_5$ | $R_5'$ | $R_6'$ | $R_7'$ | $R_8'$ |
|---|---|---|---|---|---|---|---|
| 418 | 1 | | | | | H | H |
| 419 | 1 | | | | | H | H |
| 420 | 1 | | $OCH_3$ $CH_3$ | | | H | H |
| 421 | 2 | | $OC_4H_9$ $CH_3$ | | | H | H |
| 422 | 2 | | $OCH_3$ $OCH_3$ | | | H | H |

TABLE 22-continued

| Formula No. | n | $R_4$ | $R_5$ | $R_5'$ | $R_6'$ | $R_7'$ | $R_8'$ |
|---|---|---|---|---|---|---|---|
| 423 | 2 | | | | | H | H |
| 424 | 2 | | | | | H | H |
| 425 | 2 | | $OCH_3$ $CH_3$ | | | H | H |
| 426 | 2 | | | H | H | | |
| 427 | 2 | | | $CH_3$ | H | H | isopropyl |

The compounds of the general formula

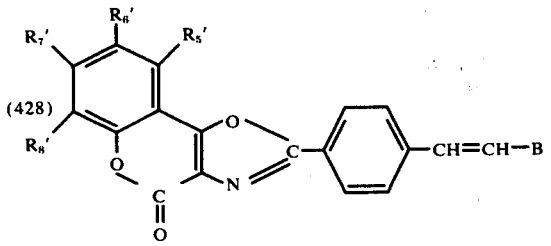
(428)
listed in Table 23 can be manufactured analogously to Example 1, 2 or 3 from triazolyl-styrene-carboxylic acids (for example DAS 1,955,066).
TABLE 23
| Formula No. | B | $R_5'$ | $R_6'$ | $R_7'$ | $R_8'$ |
|---|---|---|---|---|---|
| 429 | 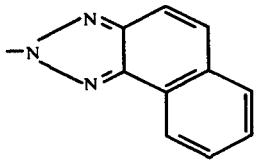 | H | H | H | H |
| 430 | 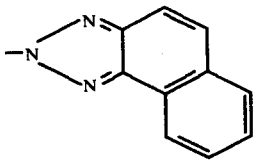 | $CH_3$ | H | H | isopropyl |
| 431 | 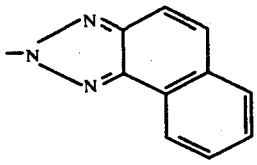 | H | t-butyl | H | H |
| 432 | 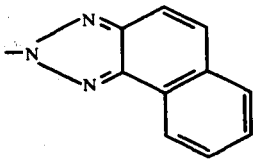 | H | H | $CH_3$ | H |
| 433 | 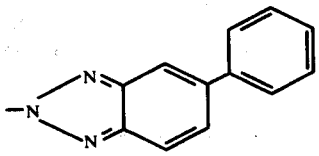 | H | H | H | H |
| 434 | 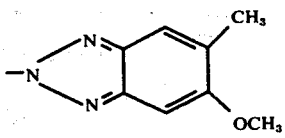 | H | H | H | H |
| 435 | 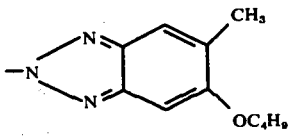 | H | H | H | H |
| 436 | 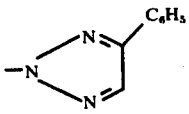 | H | H | H | H |

TABLE 23-continued
| Formula No. | B | $R_5'$ | $R_6'$ | $R_7'$ | $R_8'$ |
|---|---|---|---|---|---|
| 437 | 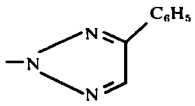 | 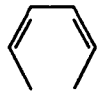 | | H | H |
| 438 | 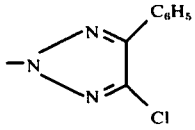 | H | H | H | H |
| 439 | 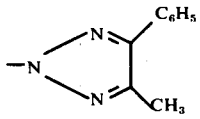 | H | H | H | H |
| 440 | 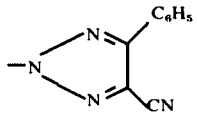 | H | H | H | H |
| 441 | 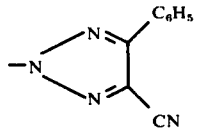 | 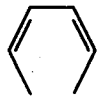 | | H | H |
| 442 | 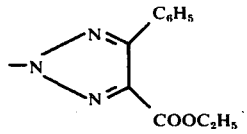 | H | H | H | H |
EXAMPLE 22
The compounds of the general formula
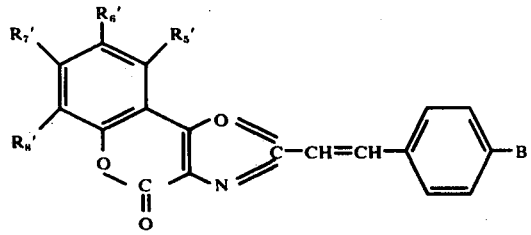
(443)
listed in Table 24 can be manufactured analogously to Example 1, 2 or 3 from 4-triazolyl-cinnamic acids (DAS 1,291,316 and 1,695,524).
TABLE 24
| Formula No. | B | $R_5'$ | $R_6'$ | $R_7'$ | $R_8'$ |
|---|---|---|---|---|---|
| 444 | 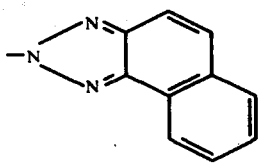 | H | H | H | H |
| 445 | 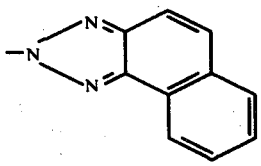 | $CH_3$ | H | H | isopropyl |

TABLE 24-continued
| Formula No. | B | $R_5'$ | $R_6'$ | $R_7'$ | $R_8'$ |
|---|---|---|---|---|---|
| 446 | 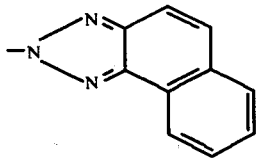 | H | t-butyl | H | H |
| 447 | 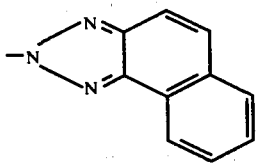 | H | H | $CH_3$ | H |
| 448 | 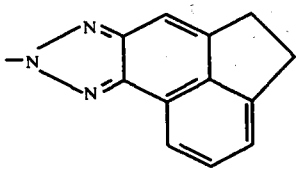 | H | H | H | H |
| 449 | 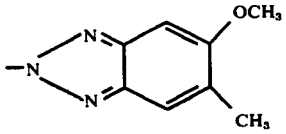 | H | H | H | H |
| 450 | 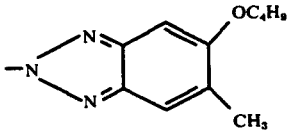 | H | H | H | H |
| 451 | 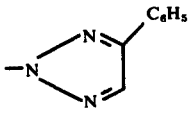 | H | H | H | H |
| 452 | 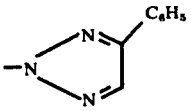 | 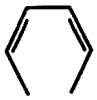 | | H | H |
| 453 | 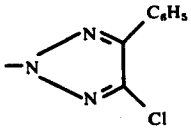 | H | H | H | H |
| 454 | 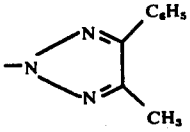 | H | H | H | H |
| 455 | 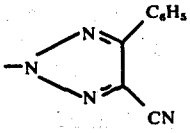 | H | H | H | H |
| 456 | 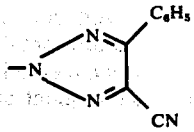 | 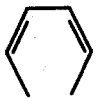 | | H | H |

TABLE 24-continued

| Formula No. | B | $R_5'$ | $R_6'$ | $R_7'$ | $R_8'$ |
|---|---|---|---|---|---|
| 457 | 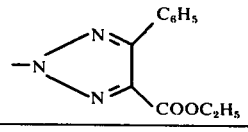 | H | H | H | H |

EXAMPLE 23

The compounds of the general formula

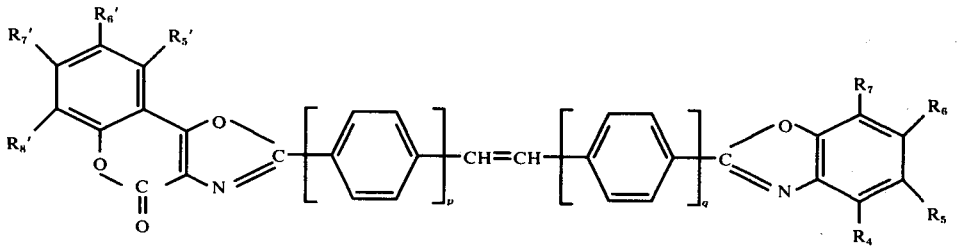

(458)

described in Table 25 can be manufactured analogously to Example 1, 2, 3 or 5.

TABLE 25

| Formula No. | p | q | $R_4$ | $R_5$ | $R_6$ | $R_7$ | $R_5'$ | $R_6'$ | $R_7'$ | $R_8'$ |
|---|---|---|---|---|---|---|---|---|---|---|
| 459 | 1 | 0 | H | H | H | H | H | H | H | H |
| 460 | 1 | 0 | H | $CH_3$ | H | H | H | H | H | H |
| 461 | 1 | 0 | H | $COOCH_3$ | H | H | H | H | H | H |
| 462 | 1 | 0 | H | H | $CH_3$ | H | H | H | H | H |
| 463 | 1 | 0 | H | $CH_3$ | H | $CH_3$ | H | H | H | H |
| 464 | 1 | 0 | H | $SO_2CH_3$ | H | H | H | H | H | H |
| 465 | 1 | 0 | H | $-C(CH_3)_3$ | H | H | H | H | H | H |
| 466 | 0 | 1 | H | H | H | H | H | H | H | H |
| 467 | 0 | 1 | H | $CH_3$ | H | H | H | H | H | H |
| 468 | 0 | 1 | H | $COOCH_3$ | H | H | H | H | H | H |
| 469 | 0 | 1 | H | H | $CH_3$ | H | H | H | H | H |
| 470 | 0 | 1 | H | $CH_3$ | H | $CH_3$ | H | H | H | H |
| 471 | 0 | 1 | H | $SO_2C_2H_5$ | H | H | H | H | H | H |
| 472 | 0 | 1 | H | $-C(CH_3)_3$ | H | H | H | H | H | H |
| 473 | 0 | 0 | H | H | H | H | H | H | H | H |
| 474 | 0 | 0 | H | H | $C_6H_5$ | H | H | H | H | H |
| 475 | 0 | 0 | 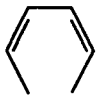 | | H | H | H | H | H | H |
| 476 | 0 | 0 | H | $CH_3$ | H | H | H | H | H | H |
| 477 | 0 | 0 | H | H | H | H | 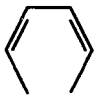 | | H | H |
| 478 | 0 | 0 | H | H | H | H | $CH_3$ | H | H | isopropyl |
| 479 | 0 | 0 | H | H | H | H | H | H | $CH_3$ | H |
| 480 | 1 | 1 | H | H | H | H | H | H | H | H |
| 481 | 1 | 1 | H | $CH_3$ | H | H | H | H | H | H |
| 482 | 1 | 1 | H | $COOCH_3$ | H | H | H | H | H | H |
| 483 | 1 | 1 | H | H | $CH_3$ | H | H | H | H | H |
| 484 | 1 | 1 | H | $CH_3$ | H | $CH_3$ | H | H | H | H |
| 485 | 1 | 1 | H | $SO_2C_2H_5$ | H | H | H | H | H | H |
| 486 | 1 | 1 | H | $-C(CH_3)_3$ | H | H | H | H | H | H |

EXAMPLE 24

100 parts of terephthalic acid ethylene glycol polyester granules are intimately mixed with 0.05 part of one of the compounds of the formulae (102), (103), (105), (119), (120), (121), (122), (123), (124), (125), (126), (127), (128), (129), (130), (131), (198), (223), (224), (225), (226), (251), (271), (279), (280), (287), (309), (310), (311) or (360) and the mixture is fused at 285° C whilst stirring. After spinning the spinning composition through customary spinnerets, strongly brightened polyester fibres are obtained.

EXAMPLE 25

A polyester fabric (based on terephthalic acid and ethylene glycol) is padded at room temperature with an aqueous dispersion which contains, per liter, 2 g of the compound of the formula (102), (120), (121), (123), (124), (125), (126), (127), (128), (223), (224) or (226) and 1 g of an addition product of about 8 mols of ethylene oxide to 1 mol of p-tert.-octylphenol, and is dried at about 100° C. The dry material is subsequently briefly subjected to a heat treatment at 220° C. The material treated in this way shows a strong brightening effect.

If instead of the polyester fabric described above a polyester fabric manufactured by co-condensation with 2 to 5 mol % of isophthalic acid-5-(sodium sulphonate) (Dacron 64) is used, a strong brightening is again achieved.

EXAMPLE 26

An intimate mixture of 100 parts of polyvinyl chloride, 3 parts of stabiliser (Advastat BD 100m, Ba/Cd complex), 2 parts of titanium dioxide, 59 parts of dioctyl phthalate and 0.01 to 0.2 part of one of the compounds of the formulae (102), (119), (120), (121), (122), (124), (125), (126), (127), (128), (129), (130), (131), (198) or (251) is milled on a calender at 150° to 155° C to give a sheet.

The opaque polyvinyl chloride sheet thus obtained has a substantially higher degree of whiteness than a sheet which does not contain the optical brightener.

EXAMPLE 27

A casting composition of 10 g of polyacrylonitrile, 0.2 g of titanium dioxide (anatase modification) as the matting agent and 40 ml of dimethylformamide, which contains 5 mg of one of the compounds of the formulae (102), (119), (121), (122), (124), (125), (126), (127), (128), (129), (130), (131) or (198) is cast on a glass plate and spread out as a thin film by means of a metal rod.

After drying, the film shows strong brightening.

EXAMPLE 28

A 15% strength casting composition of acetylcellulose in acetone which contains - based on the dry weight of plastic - 2% of anatase (titanium dioxide) as the matting agent and 0.04% of one of the compounds of the formulae (102), (121), (122), (124), (125), (126), (127), (129), (224), (225), (226) or (251), is cast on a glass plate and spread out as a thin film by means of a metal rod. After drying, the film shows a substantially higher degree of whiteness than a film manufactured in the same way which does not contain an optical brightener.

EXAMPLE 29

A 27% strength casting composition of polyurethane in ethyl acetate, which contains - relative to the dry weight of plastic - 2% of titanium dioxide (anatase modification), 5% of a stabiliser, 5% of a catalyst and 0.05% of a compound of the formulae (127) or (360), is cast on a glass plate and spread out as a thin film by means of a metal rod.

After drying, the film shows strong brightening.

EXAMPLE 30

100 parts of polystyrene and 0.1 part of one of the compounds of the formulae (120), (124), (125), (127) or (226) are fused for 20 minutes at 210° C in a tube of 1 cm diameter, with exclusion of air. After cooling, an optically brightened polystyrene composition of good fastness to light is obtained.

EXAMPLE 31

A polyester fabric is treated in an autoclave, using a liquor ratio of 1:25, in a bath of the following composition: 0.16% (based on the fibre weight of the fabric to be brightened) of the compound of the formula (226), in a finely dispersed form, 1.0 g of an ethoxylated stearyl alcohol and 1,000 ml of softened water. The bath is heated from 40° to 115° C over the course of 30 minutes and cooled, and the fabric is rinsed and dried. This gives a brilliant white polyester fabric.

If instead of the polyester fabric described above a fabric of a polyester manufactured by co-condensation with 2 to 5 mol % of isophthalic acid-5-(sodium sulphonate) (Dacron 64) is used, strong brightening effects are obtained with compounds of the formulae (223), (224) or (226).

EXAMPLE 32

A cellulose acetate fabric is introduced, using a liquor ratio of 1:30 to 1:40, into an aqueous bath at 50° C which contains 0.15% of one of the compounds of the formulae (116), (224) or (226), calculated relative to fibre material. The temperature of the treatment bath is brought to 90°–95° C and is maintained thereat for 30 to 45 minutes. After rinsing and drying, a good brightening effect is obtained.

What we claim is:

1. Coumarino-3,4-oxazoles of the formula

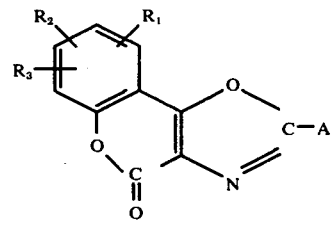

wherein $R_1$, $R_2$ and $R_3$ independently of one another represent hydrogen or a non-chromophoric substituent or $R_1$ and $R_2$ in the o-position relative to one another together represent an unsubstituted or non-chromophorically substituted fused-on benzene radical and A represents an unsubstituted or non-chromophorically substituted radical of the formulae

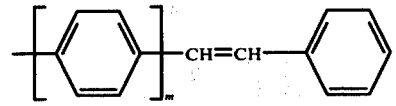

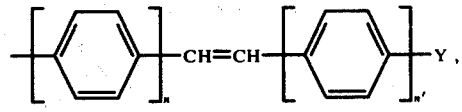

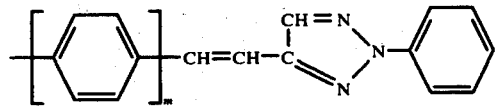

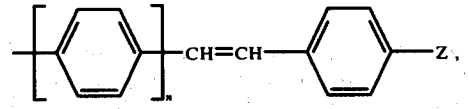

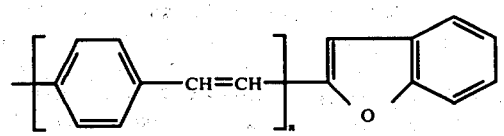

-continued

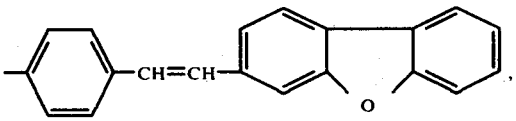

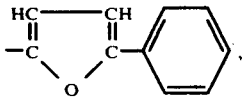

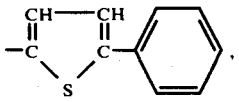

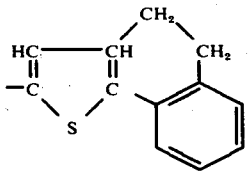

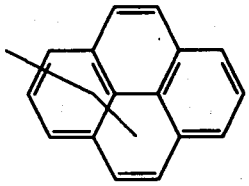

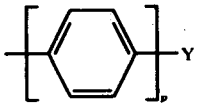

or

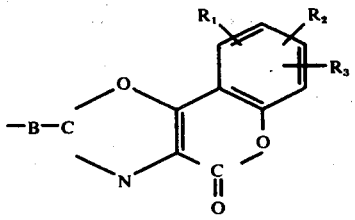

wherein Y represents an optionally non-chromophorically substituted benzoxazol-2-yl, naphthoxazol-2-yl, phenanthreno-9',19':4,5-oxazol-2-yl, benzotriazol-2-yl, naphthotriazol-2-yl or phenanthrotriazolyl-2 radical. Z represents a radical having the meaning of Y or an unsubstituted non-chromophorically substituted phenyl, 2-triazolyl, 5-phenyl-oxdiazol-2-yl, pyrazol-1-yl or 4,6-diphenyl-1,3,5-triazin-2-yl radical, B represents a radical of the formula

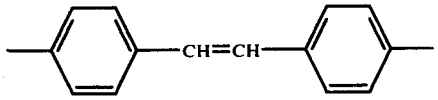

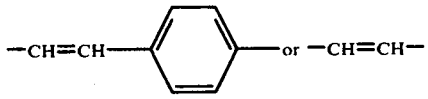

or a 1,4-phenylene, 4,4'-diphenylene, 1,4-naphthylene, 2,6-naphthylene, 2,5-furylene or 2,5-thienylene radical, or a dibenzofurane, dibenzothiophene-dioxide or 9,10-dihydrophenanthrylene-2,7 radical bonded in the 3,7-position to the oxazole radical, *m* represents the numbers 0, 1 or 2, *n* and *n'* represent the number 0 or 1 and *p* represents the number 1 or 2 and the sum of *n*+*n'* must be 1 or 2.

2. Coumarino-3,4-oxazoles according to claim 1, corresponding to the formula

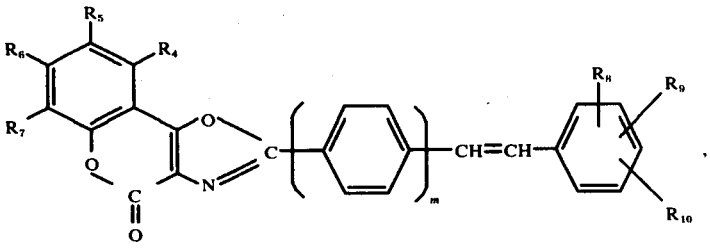

wherein two of the radicals $R_4$, $R_5$, $R_6$ and $R_7$ denote hydrogen and the others independently of one another denote hydrogen, alkyl with 1 to 4 carbon atoms, alkoxy with 1 to 4 carbon atoms or chlorine, or $R_4$ and $R_5$, $R_5$ and $R_6$ or $R_6$ and $R_7$ together denote a fused-on benzene ring, $R_8$ denotes hydrogen, halogen, alkyl with 1 to 4 carbon atoms, phenyl, alkylsulphonyl with 1 to 4 carbon atoms, benzylsulphonyl, phenylsulphonyl which is optionally substituted by alkyl with 1 to 4 carbon atoms, nitrile or a radical

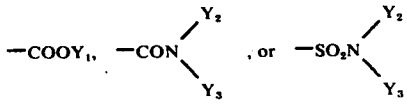

wherein $Y_1$ represents hydrogen, alkyl with 1 to 4 carbon atoms, alkoxy(1-4C)-alkyl(1-4C), cyclohexyl, benzyl or phenyl and $Y_2$ and $Y_3$ independently of one another represent hydrogen or optionally hydroxy-substituted alkyl with 1 to 4 carbon atoms or both together with the nitrogen represent a piperidine or morpholine radical, $R_9$ and $R_{10}$ independently of one another denote hydrogen, chlorine, alkyl with 1 to 4 carbon atoms or alkoxy with 1 to 4 carbon atoms and when $R_9$ and $R_{10}$ represent hydrogen and *m* represents 0 or 1, $R_8$ denotes a radical

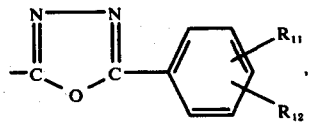

which is in the p-position to the ethylene bridge and wherein $R_{11}$ represents hydrogen, chlorine, alkyl with 1 to 4 carbon atoms, alkoxy with 1 to 4 carbon atoms, phenyl or carbalkoxy with 2 to 5 carbon atoms and $R_{12}$ represents hydrogen or alkyl with 1 to 4 carbon atoms and *m* denotes a number 0, 1 or 2.

3. Coumarino-3,4-oxazoles according to claim 1, corresponding to the formula

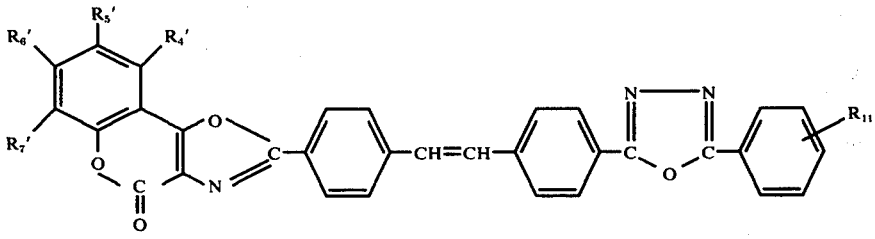

wherein two of the radicals $R_4'$, $R_5'$, $R_6'$ and $R_7'$ represent hydrogen and the others independently of one another represent hydrogen or alkyl with 1 to 4 carbon atoms or $R_4'$ and $R_5'$ together represent a fused-on benzene ring and $R_{11}'$ represents hydrogen, chlorine, alkyl with 1 to 4 carbon atoms, alkoxy with 1 to 4 carbon atoms, phenyl or carbalkoxy with 2 to 5 carbon atoms.

4. Coumarino-3,4-oxazoles according to claim 1, corresponding to the formula

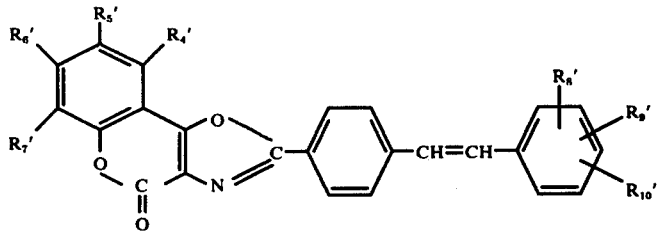

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring, $R_8'$ denotes hydrogen, halogen, alkyl with 1 to 4 carbon atoms, phenyl, alkylsulphonyl with 1 to 4 carbon atoms, benzylsulphonyl, phenylsulphonyl which is optionally substituted by alkyl with 1 to 4 carbon atoms, nitrile, carboxyl, carbalkoxy with 2 to 5 carbon atoms or a radical

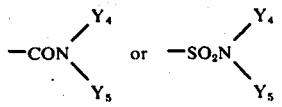

wherein $Y_4$ and $Y_5$ independently of one another represent hydrogen or alkyl with 1 to 4 carbon atoms, and $R_9'$ and $R_{10}'$ independently of one another denote hyrdogen, chlorine, alkyl with 1 to 4 carbon atoms or alkoxy with 1 to 4 carbon atoms.

5. Coumarino-3,4-oxazoles according to claim 1, corresponding to the formula

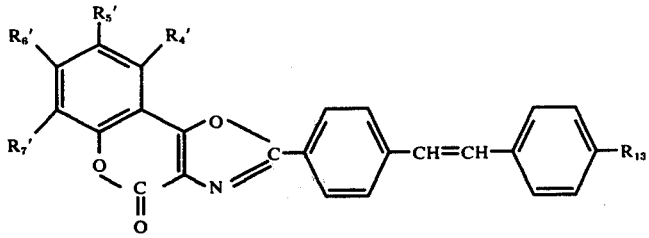

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring and $R_{13}$ represents hydrogen, nitrile, carbalkoxy with 2 to 5 carbon atoms, phenyl or alkylsulphonyl with 1 to 4 carbon atoms.

6. Coumarino-3,4-oxazoles according to claim 1, corresponding to the formula

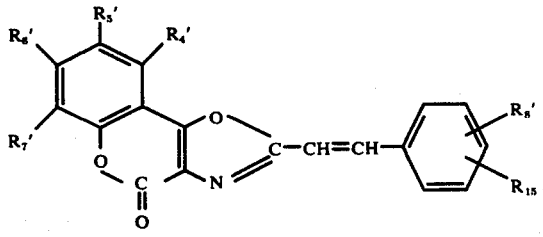

wherein two of the radicals $R_4'$, $R_5'$, $R_6'$ and $R_7'$ denote hydrogen and the others independently of one another denote hydrogen or alkyl with 1 to 4 carbon atoms, or $R_4'$ and $R_5'$ together denote a fused-on benzene ring, $R_8'$ denotes hydrogen, halogen, alkyl with 1 to 4 carbon atoms, phenyl, alkylsulphonyl with 1 to 4 carbon atoms, benzylsulphonyl, phenylsulphonyl which is optionally substituted by alkyl with 1 to 4 carbon atoms, nitrile, carboxyl, carbalkoxy with 2 to 5 carbon atoms or a radical

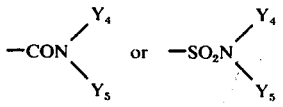

wherein $Y_4$ and $Y_5$ independently of one another represent hydrogen or alkyl with 1 to 4 carbon atoms and $R_{15}$ denotes hydrogen, alkyl with 1 to 4 carbon atoms or chlorine.

7. Coumarino-3,4-oxazoles according to claim 1, corresponding to the formula

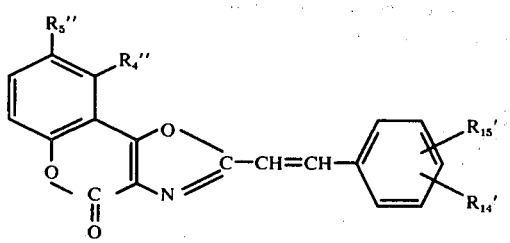

wherein $R_4''$ and $R_5''$ denote hydrogen or together denote a fused-on benzene radical, $R_{14}'$ denotes hydrogen, nitrile, alkoxy with 1 to 4 carbon atoms or carbalkoxy with 2 to 5 carbon atoms or together with $R_{15}'$ denotes a fused-on benzene radical and $R_{15}'$ denotes hydrogen or together with $R_{14}'$ denotes a fused-on benzene radical.

8. Coumarino-3,4-oxazoles according to claim 1, corresponding to the formula

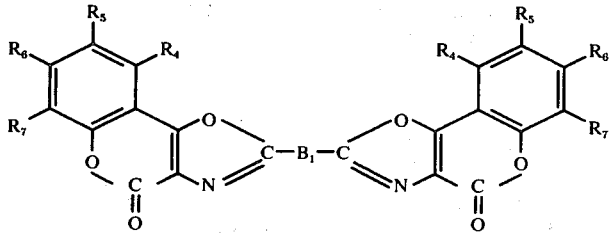

wherein two of the radicals $R_4$, $R_5$, $R_6$ and $R_7$ denote hydrogen and the others independently of one another denote hydrogen, alkyl with 1 to 4 carbon atoms, alkoxy with 1 to 4 carbon atoms or chlorine or, further, $R_4$ and $R_5$, $R_5$ and $R_6$ or $R_6$ and $R_7$ together denote a fused-on benzene ring and $B_1$ denotes a radical of the formulae

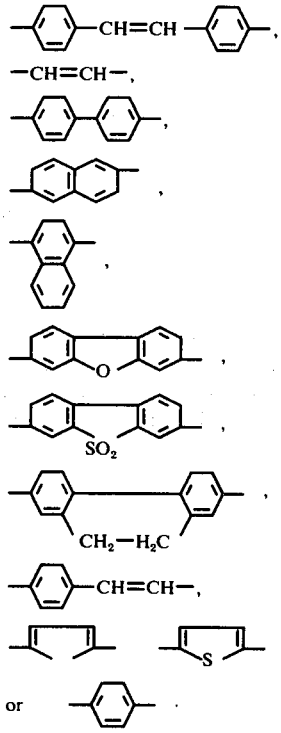

9. Coumarino-3,4-oxazoles according to claim 1, corresponding to the formula

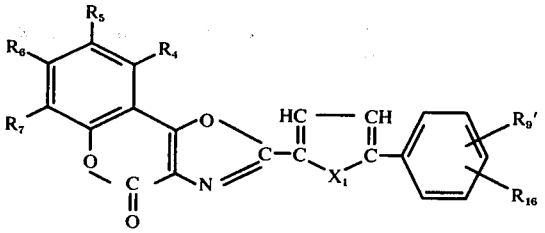

wherein two of the radicals $R_4$, $R_5$, $R_6$ and $R_7$ denote hydrogen and the others independently of one another denote hydrogen, alkyl with 1 to 4 carbon atoms, alkoxy with 1 to 4 carbon atoms or chlorine or $R_4$ and $R_5$, $R_5$ and $R_6$ or $R_6$ and $R_7$ together denote a fused-on benzene ring, $R_9'$ denotes hydrogen, chlorine, alkyl with 1 to 4 carbon atoms or alkoxy with 1 to 4 carbon atoms, $R_{16}$ denotes hydrogen, chlorine, alkyl with 1 to 4 carbon atoms, alkoxy with 1 to 4 carbon atoms, nitrile, carbalkoxy with 2 to 5 carbon atoms, alkylsulphonyl with 1 to 4 carbon atoms or phenylsulphonyl and $X_1$ denotes oxygen or sulphur.

10. Coumarino-3,4-oxazoles according to claim 1, corresponding to the formula

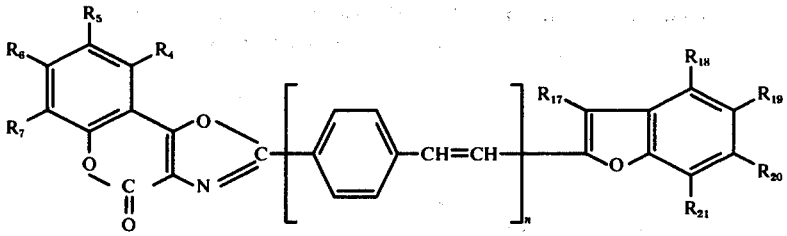

wherein two of the radicals $R_4$, $R_5$, $R_6$ and $R_7$ denote hydrogen and the others independently of one another denote hydrogen, alkyl with 1 to 4 carbon atoms, alkoxy with 1 to 4 carbon atoms or chlorine or $R_4$ and $R_5$, $R_5$ and $R_6$ or $R_6$ and $R_7$ together denote a fused-on benzene ring, $R_{17}$ denotes hydrogen, methyl or phenyl, two of the radicals $R_{18}$, $R_{19}$, $R_{20}$ and $R_{21}$ denote hydrogen and the two others independently of one another denote hydrogen, chlorine, alkyl with 1 to 4 carbon atoms or alkoxy with 1 to 4 carbon atoms or $R_{18}$ and $R_{19}$ together denote a fused-on benzene radical and *n* denotes the number 0 or 1.

11. Coumarino-3,4-oxazoles according to claim 1, corresponding to the formula

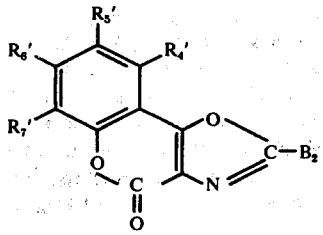

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring and $B_2$ represents a radical of the formula

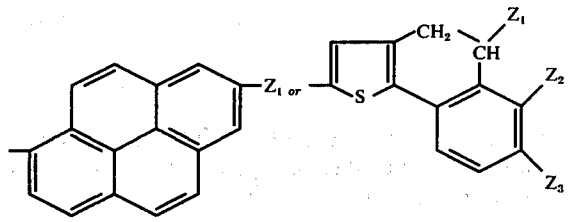

wherein $Z_1$ represents hydrogen or alkyl with 1 to 4 carbon atoms and $Z_2$ and $Z_3$ independently of one another represent hydrogen, chlorine or alkyl with 1 to 4 carbon atoms.

12. Coumarino-3,4-oxazoles according to claim 1, corresponding to the formula

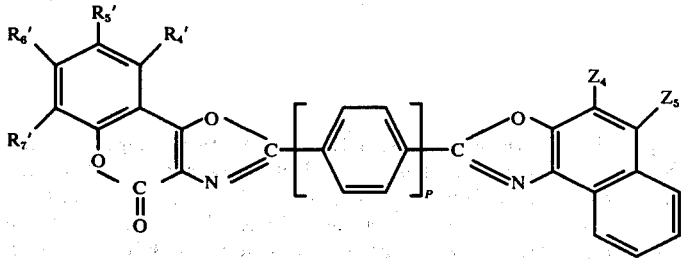

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring, $Z_4$ denotes hydrogen, nitrile, carboxyl, carbalkoxy with 2 to 5 carbon atoms or carbamoyl, or together with $Z_5$ denotes a fused-on benzene ring, and $Z_5$ represents hydrogen or together with $Z_4$ represents a fused-on benzene ring and *p* denotes the number 1 or 2.

13. Coumarino-3,4-oxazoles according to claim 1, corresponding to the formula

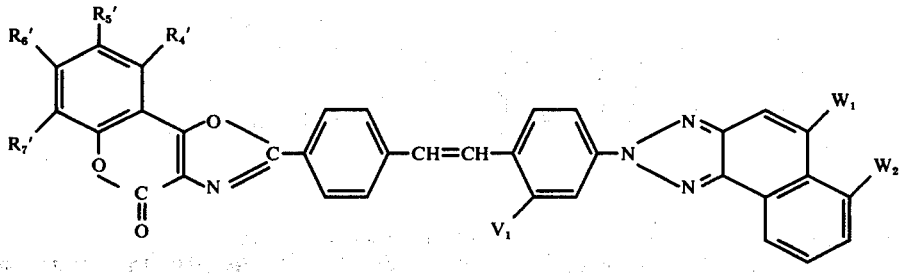

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring, $V_1$ denotes hydrogen, nitrile or alkylsulphonyl with 1 to 4 carbons and $W_1$ and $W_2$ denote hydrogen or together denote an ethylene bridge.

14. Coumarino-3,4-oxazoles according to claim 1, corresponding to the formula

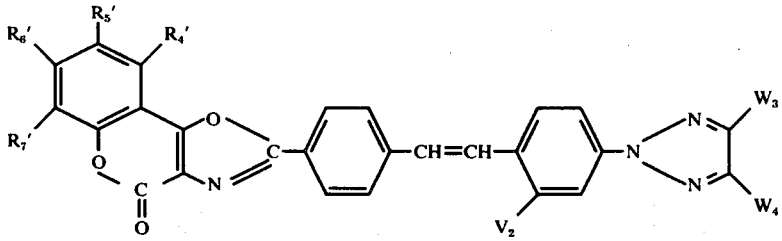

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring, $V_2$ denotes hydrogen, nitrile or alkylsulphonyl with 1 to 4 carbon atoms, $W_3$ denotes hydrogen, chlorine, alkyl with 1 to 4 carbon atoms, carbalkoxy with 2 to 5 carbon atoms or nitrile, $W_4$ denotes hydrogen, alkyl with 1 to 4 carbon atoms, phenyl or styryl or $W_3$ and $W_4$ together denote a fused-on benzene radical which can be substituted in the 5-position by alkyl with 1 to 4 carbon atoms or alkoxy with 1 to 4 carbon atoms and can be substituted in the 6-position by alkoxy with 1 to 4 carbon atoms, or denote a fused-on naphthalene or acenaphthene radical.

15. Coumarino-3,4-oxazoles according to claim 1, corresponding to the formula

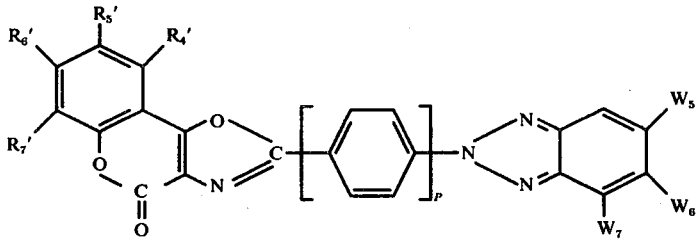

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring, $W_5$ denotes alkyl with 1 to 4 carbon atoms or alkoxy with 1 to 4 carbon atoms, $W_6$ denotes alkoxy with 1 to 4 carbon atoms and $W_7$ denotes hydrogen or $W_5$ denotes hydrogen and $W_6$ and $W_7$ together denote the supplementary portion required to form a naphthalene radical or $W_5$, $W_6$ and $W_7$ together represent the supplementary portion required to form an acenaphthene radical and *p* deontes the number 1 or 2.

16. Coumarino-3,4-oxazoles according to claim 1, corresponding to the formula

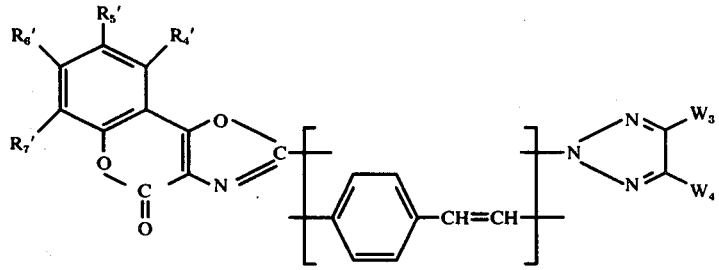

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring, $W_3$ denotes hydrogen, chlorine, alkyl with 1 to 4 carbon atoms, carbalkoxy with 2 to 5 carbon atoms or nitrile, $W_4$ denotes hydrogen, alkyl with 1 to 4 carbon atoms, phenyl or styryl or $W_3$ and $W_4$ together denote a fused-on benzene ring which can be substituted in the 5-position by alkyl with 1 to 4 carbon atoms or alkoxy with 1 to 4 carbon atoms and can be substituted in the 6-position by alkoxy with 1 to 4 carbon atoms, or denote a fused-on naphthalene or acenaphthene radical.

17. Coumarino-3,4-oxazoles according to claim 1, corresponding to the formula

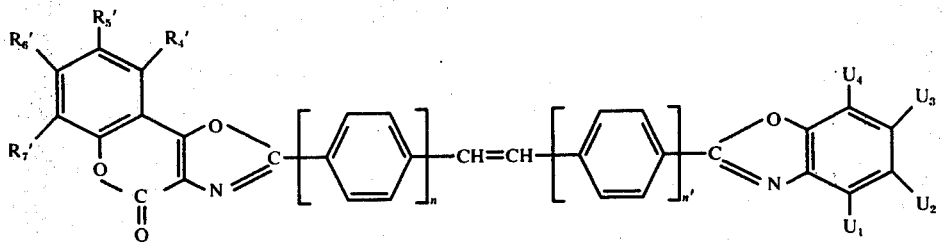

wherein two of the radicals $R_4'$, $R_5'$, $R_6'$ and $R_7'$ denote hydrogen and the others independently of one another denote hydrogen or alkyl with 1 to 4 carbon atoms or $R_4'$ and $R_5'$ together denote a fused-on benzene ring, $U_1$ denotes hydrogen or together with $U_2$ denotes a fused-on benzene radical, $U_2$ denotes hydrogen, chlorine, alkyl with 1 to 4 carbon atoms, carbalkoxy with 2 to 5 carbon atoms, phenyl, alkylsulphonyl with 1 to 4 carbon atoms or phenylsulphonyl or together with $U_1$ denotes a fused-on benzene radical, $U_3$ denotes hydrogen, methyl or phenyl, $U_4$ denotes hydrogen or alkyl with 1 to 4 carbon atoms and $n$ and $n'$ denote the number 0 or 1, and the sum of $n+n'$ must be 1 to 2.

* * * * *

UNITED STATES PATENT AND TRADEMARK OFFICE

CERTIFICATE OF CORRECTION

PATENT NO. : 4,017,483

DATED : April 12, 1977

INVENTOR(S) : Hans Rudolf Meyer

It is certified that error appears in the above-identified patent and that said Letters Patent are hereby corrected as shown below:

Column 67, claim 1, line 55, delete the structural formula as it now reads and insert

---

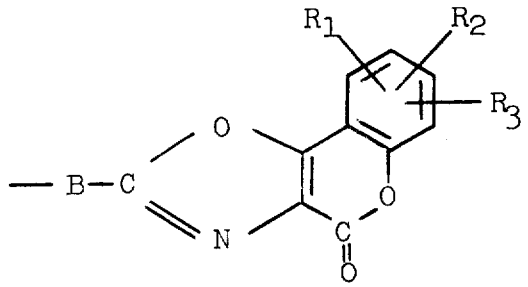

---.

Column 67, claim 1, line 65, after "unsubstituted" insert --- or ---.

Column 70, claim 4, lines 20-21, delete "hyrdogen" and insert --- hydrogen ---.

Column 78, claim 17, line 17, delete "to" and insert --- or ---.

Signed and Sealed this twenty-sixth Day of July 1977

[SEAL]

Attest:

RUTH C. MASON
Attesting Officer

C. MARSHALL DANN
Commissioner of Patents and Trademarks